US011217185B2

(12) United States Patent
Jeong et al.

(10) Patent No.: US 11,217,185 B2
(45) Date of Patent: Jan. 4, 2022

(54) DISPLAY DEVICE AND FABRICATING METHOD THEREOF

(71) Applicant: Samsung Display Co., Ltd., Yongin-Si (KR)

(72) Inventors: Jin Tae Jeong, Yongin-si (KR); Ji Hyun Ka, Yongin-si (KR); Tae Hoon Kwon, Yongin-si (KR); Min Ku Lee, Yongin-si (KR); Seung Ji Cha, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/163,616

(22) Filed: Feb. 1, 2021

(65) Prior Publication Data

US 2021/0158764 A1 May 27, 2021

Related U.S. Application Data

(63) Continuation of application No. 16/687,475, filed on Nov. 18, 2019, now Pat. No. 10,909,934, which is a (Continued)

(30) Foreign Application Priority Data

Sep. 21, 2016 (KR) ..... 10-2016-0120907

(51) Int. Cl.
*G09G 3/34* (2006.01)
*G09G 3/20* (2006.01)
(Continued)

(52) U.S. Cl.
CPC ..... *G09G 3/342* (2013.01); *G09G 3/20* (2013.01); *G09G 3/3266* (2013.01); *G09G 3/02* (2013.01);
(Continued)

(58) Field of Classification Search
CPC .... G09G 2310/0216; G09G 3/20; G09G 3/02; G09G 2300/0426; G09G 3/3266; G09G 2310/0281; G09G 3/342
See application file for complete search history.

(56) References Cited

U.S. PATENT DOCUMENTS 8,064,027 B2 11/2011 Choi et al.
8,129,722 B2 3/2012 Sung et al.
(Continued)

FOREIGN PATENT DOCUMENTS

EP 0950917 A1 10/1999
JP 2005-208449 A 8/2005
(Continued)

OTHER PUBLICATIONS

Partial European Search Report for 17192006.9, dated Nov. 10, 2017.
(Continued)

*Primary Examiner* — Charles V Hicks
(74) *Attorney, Agent, or Firm* — Innovation Counsel LLP

(57) ABSTRACT

A display device includes first and second pixel areas spaced apart from each other so that corresponding scan lines are separate from each other, a first non-pixel area at a periphery of the first pixel area, a second non-pixel area at a periphery of the second pixel area and opposite to the first non-pixel area with at least one pixel area interposed therebetween,
(Continued)

first scan lines in the first pixel area, second scan lines in the second pixel area, a first scan driver in the first non-pixel area and connected to the first scan lines, a second scan driver in the second non-pixel area and connected to the second scan lines, first wires in the first non-pixel area and connected to the first scan driver, second wires in the second non-pixel area and connected to the second scan driver; and connecting wires connecting the first wires and second wires.

20 Claims, 26 Drawing Sheets

Related U.S. Application Data continuation of application No. 15/683,498, filed on Aug. 22, 2017, now Pat. No. 10,482,829.

(51) Int. Cl.
*G09G 3/3266* (2016.01)
*G09G 3/02* (2006.01)

(52) U.S. Cl.
CPC ..... *G09G 2300/0426* (2013.01); *G09G 2310/0216* (2013.01); *G09G 2310/0281* (2013.01)

(56) References Cited

U.S. PATENT DOCUMENTS

| | | | | |
|---|---|---|---|---|
| 8,704,762 | B2 | 4/2014 | Sung et al. | |
| 2006/0033857 | A1 | 2/2006 | Kim et al. | |
| 2006/0139551 | A1 | 6/2006 | Kimura | |
| 2011/0084955 | A1 | 4/2011 | Kim | |
| 2016/0011633 | A1* | 1/2016 | Watanabe | G09G 3/3648 345/184 |
| 2016/0195740 | A1 | 7/2016 | Jeon et al. | |

FOREIGN PATENT DOCUMENTS

| | | | |
|---|---|---|---|
| KR | 10-0227981 | B1 | 11/1999 |
| KR | 10-0884463 | B1 | 2/2009 |
| KR | 10-1101070 | B1 | 12/2011 |
| KR | 10-1300914 | B1 | 8/2013 |
| KR | 10-1326246 | B1 | 11/2013 |
| KR | 10-2016-0084963 | A | 7/2016 |

OTHER PUBLICATIONS

Extended European Search Report, Application No. 17192006.9, dated Mar. 6, 2018, pp. 1-24.

* cited by examiner

DISPLAY DEVICE AND FABRICATING METHOD THEREOF

RELATED APPLICATIONS

This application is a continuation application of U.S. patent application Ser. No. 16/687,475 filed on Nov. 18, 2019, which is a continuation application of U.S. patent application Ser. No. 15/683,498 filed on Aug. 22, 2017 (now U.S. Pat. No. 10,482,829), which claims priority under 35 USC § 119 to Korean Patent Application No. 10-2016-0120907 filed on Sep. 21, 2016 in the Korean Intellectual Property Office, the entire contents of which are incorporated herein by reference in their entirety.

BACKGROUND

1. Field

An aspect of the present disclosure relates to a display device and a fabricating method thereof.

2. Description of the Related Art

Recently, display devices having various shapes have seen increased demand. Accordingly, a technical scheme reducing a defect rate while effectively driving display areas having various shapes has been the subject of recent efforts.

SUMMARY

The present disclosure provides a display device capable of more effectively driving a plurality of pixel areas spaced apart from each other while reducing a defect rate, as well as a method of fabricating the same.

According to an aspect of the present disclosure, there is provided a display device including a substrate including a first pixel area and a second pixel area spaced apart from each other so that corresponding scan lines are separate from each other, a first non-pixel area at a periphery of the first pixel area, and a second non-pixel area at a periphery of the second pixel area and opposite to the first non-pixel area with at least one pixel area interposed therebetween, first scan lines and first pixels in the first pixel area, second scan lines and second pixels in the second pixel area, a first scan driver in the first non-pixel area and connected to the first scan lines, a second scan driver in the second non-pixel area and connected to the second scan lines, a plurality of first wires in the first non-pixel area and connected to the first scan driver, a plurality of second wires in the second non-pixel area and connected to the second scan driver, and a plurality of connecting wires connecting the first wires and the second wires.

The first pixel area and the second pixel area may be arranged proximate to each other to be spaced apart from each other along an extension line extending in a longitudinal direction of the first scan lines and the second scan lines.

The first pixel area and the second pixel area may be arranged to be opposite to each other with at least one non-pixel area interposed therebetween.

The first and second wires may be arranged to supply at least one of a start pulse and a clock signal to the first and second scan drivers, respectively.

The display device may further include first scan pads connected to the first wires and second scan pads connected to the second wires, a third pixel area on one side of the first and second pixel areas, third scan lines and third pixels in the third pixel area, and a third scan driver in a third non-pixel area at a periphery of the third pixel area and connected to the third scan lines.

The first wires may extend to the first non-pixel area via the third non-pixel area, from a fourth non-pixel area in which the first scan pads are arranged.

At least one of the first wires may be connected to the first scan driver and the third scan driver.

The display device further includes a fourth scan driver in a fifth non-pixel area at a periphery of the third pixel area and connected to the third scan lines.

At least one of the second wires may be connected to the second scan driver and the fourth scan driver.

The second wires may extend to the second non-pixel area via a fifth non-pixel area opposite to the third non-pixel area from the fourth non-pixel area in which the second scan pads are arranged.

The connecting wires may be arranged in a fourth non-pixel area in which the first and second scan pads are arranged.

The connecting wires may be arranged in a sixth non-pixel area connecting the first non-pixel area and the second non-pixel area.

The first wires may include a first signal line configured to receive a first control signal, and a second signal line configured to receive a second control signal. The second wires may include a third signal line configured to receive the first control signal, and a fourth signal line configured to receive the second control signal. The connecting wires may include a first connecting wire connecting the first signal line and the third signal line, and a second connecting wire connecting the second signal line and the fourth signal line.

The first connecting wire and the second connecting wire may have different structures.

The second connecting wire may include a first sub wire formed of a same material and on a same layer as the second and fourth signal lines, a second sub wire connected between the first sub wire and the second signal line and arranged on a different layer from the first sub wire, and a third sub wire connected between the first sub wire and the fourth signal line and arranged on a different layer from the first sub wire. The first connecting wire may be formed of a single wire arranged to be spaced apart from the first sub wire and on a same layer as the first sub wire, or a single wire arranged to be spaced apart from the second and third sub wires and on a same layer as the second and third sub wires.

The substrate may include a concave portion between the first pixel area and the second pixel area.

The display device may further include first scan pads connected to the first wires and second scan pads connected to the second wires, wherein at least one of the first scan pads and at least one of the second scan pads are configured to receive the same signals.

According to an embodiment, a method of fabricating a display device including a first pixel area and a second pixel area arranged to be spaced apart from each other on different sides, may include: forming first and second pixels in the first and second pixel areas, respectively, and first and second wires respectively arranged on different sides of the substrate and configured to transmit driving signals for driving the first and second pixels, the first and second wires being positioned inside a scribing line defined in an individual panel area on a substrate; forming first and second test pads connected to the first and second wires, respectively, the first and second test pads being positioned outside the scribing line; forming a plurality of connecting wires each connecting pairs of the test pads to which same signals are to be applied, the connecting wires being positioned either inside or outside the scribing line; performing a predetermined test on the display device by supplying test control signals to the first and second test pads; and separating the first and second test pads from the display device by performing a scribing process along the scribing line.

The method may further include forming a first scan driver connected between the first pixel area and the first wires, and a second scan driver connected between the second pixel area and the second wires, the first and second scan drivers being positioned within the scribing line.

The performing may further comprise concurrently supplying the test control signals to the first and second test pads.

The method further includes forming a third pixel area on one side of the first and second pixel areas.

In the forming of the first and second wires, the first wires may be formed on one side of the first pixel area and one side of the third pixel area, and the second wires may be formed on one side of the second pixel area and another side of the third pixel area to be opposite to the first wires.

The performing may further comprise applying same test control signals to at least one of the first test pads and at least one of the second test pads.

The forming a plurality of connecting wires may further comprise forming the connecting wires to include at least one conductive layer on a different layer from a conductive layer constituting the first and second wires.

The forming a plurality of connecting wires may further comprise forming a first connecting wire connecting first and third signal pads to be supplied with a first test control signal, and forming a second connecting wire connecting second and fourth signal pads to be supplied with a second test control signal.

The first connecting wire and the second connecting wire may have different structures.

The connecting wires may be formed outside the scribing line, and the separating may further comprise separating both the connecting wires and the first and second test pads.

DETAILED DESCRIPTION

Figure 1A:
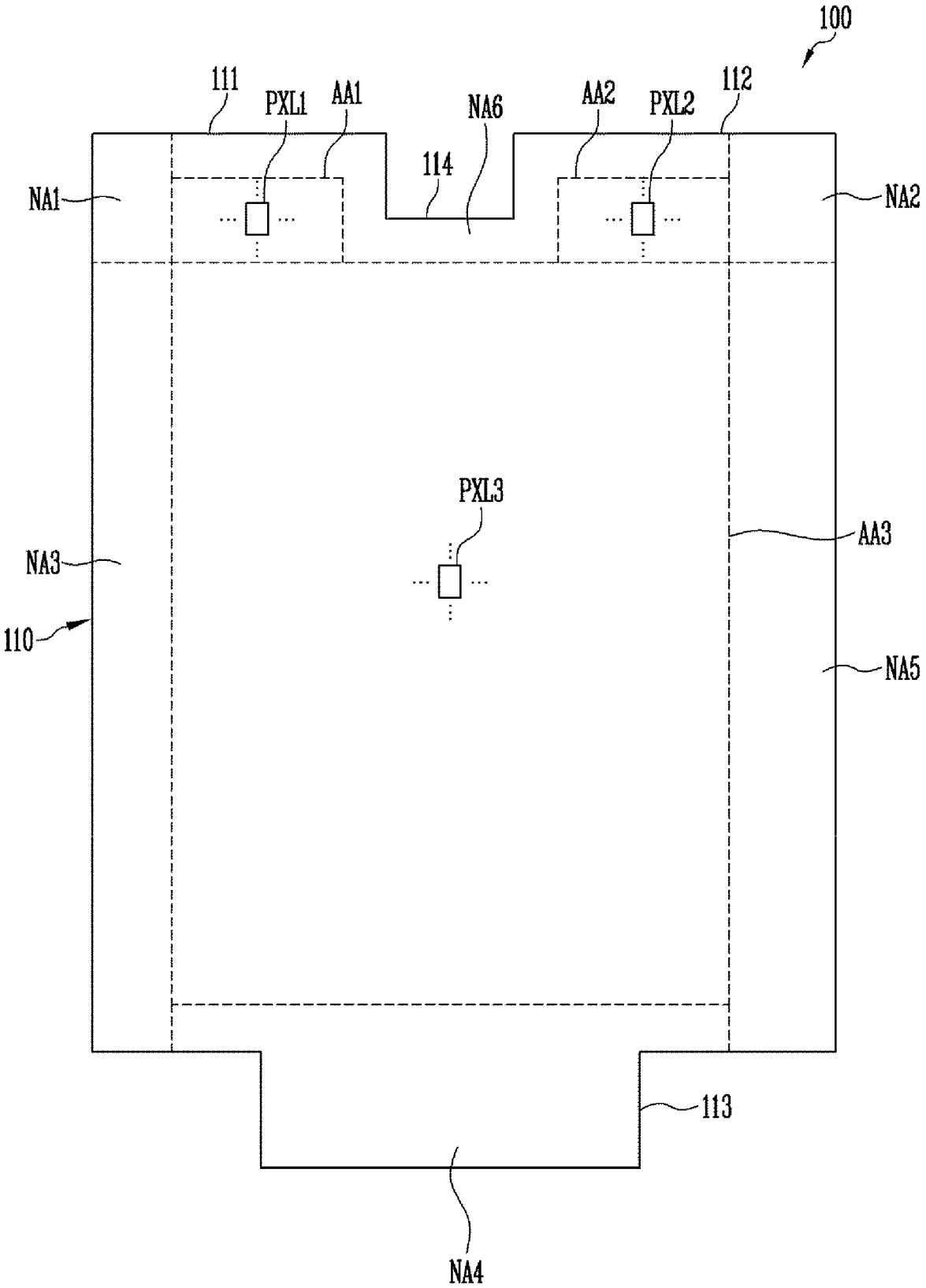
FIGS. 1A, 1B, 1C, 1D, 1E, and 1F illustrate a display device according to an embodiment of the present disclosure, more particularly, a substrate including a display area and a non-display area.

Hereinafter, embodiments of the present disclosure will be described in detail with reference to the accompanying drawings. However, the embodiments described below are merely illustrative regardless of their representations. That is, the present disclosure is not limited to the embodiments described below, but may be modified into various forms.

In the drawings, some of the constituent elements not directly related to the features of the present disclosure may be omitted to clearly illustrate the present disclosure. In addition, some of the constituent elements in the drawings may be exaggerated in size, ratio, or the like. In the drawings, the same or similar constituent elements are denoted by the same reference numerals and marks as possible although shown in different drawings. The various drawings may not be to scale. All numerical values are approximate, and may vary. All examples of specific materials and compositions are to be taken as nonlimiting and exemplary only. Other suitable materials and compositions may be used instead.

FIGS. 1A to 1F illustrate a display device according to an embodiment of the present disclosure, more particularly, a substrate including a display area and a non-display area.

Referring to FIG. 1A, a display device 100 according to an embodiment of the present disclosure may include a substrate 110 including a plurality of pixel areas AA1, AA2 and AA3 and non-pixel areas NA1 to NA6 positioned at peripheries of the pixel areas AA1, AA2 and AA3. The pixel areas AA1, AA2 and AA3 may constitute a display area, and the non-pixel areas NA1 to NA6 may constitute a non-display area.

According to an embodiment, the substrate 110 may be formed of glass or plastic, but the present disclosure is not limited thereto. For example, the substrate 110 may be a flexible substrate including at least one of polyethersulfone (PES), polyacrylate, polyetherimide (PEI), polyethylene naphthalate (PEN), polyethylene terephthalate (PET), polyphenylene sulfide (PPS), polyarylate (PAR), polyimide (PI), polycarbonate (PC), cellulose triacetate (TAC) and cellulose acetate propionate (CAP). The substrate 110 may be a rigid substrate including at least one of glass and tempered glass. Further, the substrate 110 may be formed of a substrate of a transparent material, that is, a transparent substrate, but the present disclosure is not limited thereto.

According to an embodiment, the display area may include a first pixel area AA1 and a second pixel area AA2 spaced apart from each other. The display area may further include at least one pixel area, for example, a third pixel area AA3. The display device 100 according to an embodiment of the present disclosure may include two or more pixel areas in which control lines such as scan lines are separated from each other, for example, the first and second areas AA1 and AA2. However, the numbers or the structures of pixel areas AA1, AA2, and AA3 constituting the display area are not limited thereto.

A plurality of pixels PXL1, PXL2 and PXL3 may be arranged in the pixel areas AA1, AA2 and AA3, respectively. Accordingly, a predetermined image may be displayed in each of the pixel areas AA1, AA2, and AA3. That is, the pixel areas AA1, AA2, and AA3 may constitute the display area.

Constituent elements (for example, a driving circuit, a wire, etc.) for driving the pixels PXL1, PXL2 and PXL3 may be arranged in the non-pixel areas NA1 to NA6. The pixels PXL1, PXL2 and PXL3 may not be arranged in the non-pixel areas NA1 to NA6. Accordingly, the non-pixel areas NA1 to NA6 may constitute the non-display area. The non-pixel areas NA1 to NA6 may be arranged at peripheries of the pixel areas AA1, AA2, and AA3. For example, the non-pixel areas NA1 to NA6 may be arranged on at least one side of the pixel areas AA1, AA2 and AA3 and surround the pixel areas AA1, AA2 and AA3. According to an embodiment, widths of the non-pixel areas NA1 to NA6 may be determined to be identical to one another, or different from one another according to the positions thereof.

According to an embodiment, the pixel areas AA1, AA2 and AA3 may include the first pixel area AA1 and the second pixel area AA2 arranged to be spaced apart from each other, and the third pixel area AA3 arranged on one side of the first and second pixel areas AA1 and AA2.

According to an embodiment, the first pixel area AA1 and the second pixel area AA2 may be arranged to be opposite to each other with at least one non-pixel area interposed therebetween. For example, the first pixel area AA1 and the second pixel area AA2 may be arranged to be opposite to each other above the third area AA3 with part of a sixth non-pixel area NA6 interposed therebetween. For example, the first pixel area AA1 may be arranged above the left side of the third pixel area AA3, and the second pixel area AA2 may be arranged above the right side of the third pixel area AA3.

According to an embodiment, the third pixel area AA3 may be arranged to have a largest area in a center of the substrate 110. In addition, each of the first pixel area AA1 and the second pixel area AA2 may have a smaller area than the third pixel area AA3. The first pixel area AA1 and the second pixel area AA2 may have the same areas or different areas. However, the present disclosure is not limited thereto, and sizes and/or positions of the pixel areas AA1, AA2 and AA3 may be changed variously.

According to an embodiment, the first pixels PXL1, the second pixel PXL2, and the third pixel PXL3 may be arranged in the first pixel area AA1, the second pixel area AA2, and the third pixel area PXL3, respectively. In addition, although not shown in FIGS. 1A to 1F, first scan lines connected to the first pixels PXL1, second scan lines connected to the second pixels PXL2, and third scan lines connected to the third pixels PXL3 may be arranged in the first pixel area AA1, the second pixel area AA2 and the third pixel area AA3, respectively. The first to third pixels PXL1, PXL2 and PXL3 may emit light of a predetermined brightness corresponding to control signals (for example, a scan signal and a data signal) supplied from a driving circuit and/or wires arranged in the non-pixel areas NA1 to NA6.

According to an embodiment, the non-pixel areas NA1 to NA6 may include a first non-pixel area NA1, a second non-pixel area NA2, a third non-pixel area NA3, a fourth non-pixel area NA4, a fifth non-pixel area NA5, and the sixth non-pixel area NA6.

According to an embodiment, the first non-pixel area NA1 may be arranged at a periphery of the first pixel area AA1. For example, the first non-pixel area NA1 may be arranged on the left side corner of the first pixel area AA1.

According to an embodiment, the second non-pixel area NA2 may be arranged at a periphery of the second pixel area AA2 and opposite to the first non-pixel area NA1 with at least one pixel area interposed therebetween. For example, the second non-pixel area NA2 may be arranged on the right side corner of the second pixel area AA2. For example, the second non-pixel area NA2 may be opposite to the first non-pixel area NA1 with the first pixel area AA1 and the second pixel area AA2 interposed therebetween. According to an embodiment, widths of the first non-pixel area NA1 and the second non-pixel area NA2 may be the same as or different from each other.

According to an embodiment, the third non-pixel area NA3 may be arranged at a periphery of the third pixel area AA3. For example, the third non-pixel area NA3 may be arranged on the left side of the third pixel area AA3.

According to an embodiment, the fourth non-pixel area NA4 may be arranged at a periphery of the third pixel area AA3. For example, the fourth non-pixel area NA4 may be arranged under the third pixel area AA3. That is, the fourth pixel area NA4 may be the non-pixel area arranged in the lower section of the display device 100.

According to an embodiment, the fifth non-pixel area NA5 may be arranged at a periphery of the third pixel area AA3. For example, the fifth non-pixel area NA5 may be arranged on the right side of the third pixel area AA3. According to an embodiment, the third non-pixel area NA3 and the fifth non-pixel area NA5 are positioned opposite to each other and may have the same or different widths.

According to an embodiment, the sixth non-pixel area NA6 may be arranged at peripheries of the first to third pixel areas AA1, AA2 and AA3. For example, the sixth non-pixel area NA6 may be arranged above the first to third areas AA1, AA2 and AA3. That is, the sixth pixel area NA6 may be the non-pixel area arranged in the upper section of the display device 100.

According to an embodiment, a driving circuit such as a scan driver or a light emitting control driver, wires and/or pads may be arranged in at least one of the first to sixth non-pixel areas NA1 to NA6. An embodiment related to the above will be described below.

According to an embodiment, the substrate 110 may have various shapes in which the pixel areas AA1, AA2 and AA3 and the non-pixel areas NA1 to NA6 are arranged. For example, the substrate 110, on the basis of a center of a square shape, may include a first protrusion 111 and a second protrusion 112 extending from one side of the substrate 110, for example, a top, and a concave portion 114 arranged between the first and second protrusions 111 and 112. In addition, according to an embodiment, the substrate 110 may include a third protrusion 113 extending and protruding from another side of the center of the substrate 100, for example, a bottom.

According to an embodiment, the first pixel area AA1 and the second pixel area AA2 may be arranged in the first protrusion 111 and the second protrusion 112, respectively. According to an embodiment, the concave portion 114 may be provided between the first pixel area AA1 and the second pixel area AA2. To this end, at least one portion between the first pixel area AA1 and the second pixel area AA2 of the substrate 110 may be removed or opened.

According to an embodiment, pads and/or at least one driving circuit that are not shown may be arranged in the third protrusion 113. According to an embodiment, the first protrusion 111, the second protrusion 112, and the third protrusion 113 may be formed as an integrated body that designates one substrate as a base substrate (i.e. extensions of the same body). However, the present disclosure is not limited thereto.

As described above, the display device 100 according to an embodiment may include two or more pixel areas in which scan lines such as control lines are separated from each other, for example, the first and second pixel areas AA1 and AA2. In addition, according to an embodiment, the display device 100 according to an embodiment of the present disclosure may further include at least one pixel area, for example, the third pixel area AA3 in addition to the first and second areas AA1 and AA2. However, the present disclosure is not limited thereto.

That is, the substrate 110 and the pixel areas AA1, AA2 and AA3 arranged on the substrate 110 may have various shapes. For example, the substrate 110, the first pixel area AA1, the second pixel area AA2 and/or the third pixel area AA3 may have a polygonal shape, a circle shape, etc. In addition, according to an embodiment, at least one portion of the substrate 110, the first pixel area AA1, the second pixel area AA2 and/or the third pixel area AA3 may have a linear shape.

For example, as shown in FIG. 1A, the first pixel area AA1, the second pixel area AA2 and/or the third pixel area AA3 may have rectangular shapes. In addition, each corner of the substrate 110 may have a perpendicular shape, e.g. with square corners.

Figure 1B:
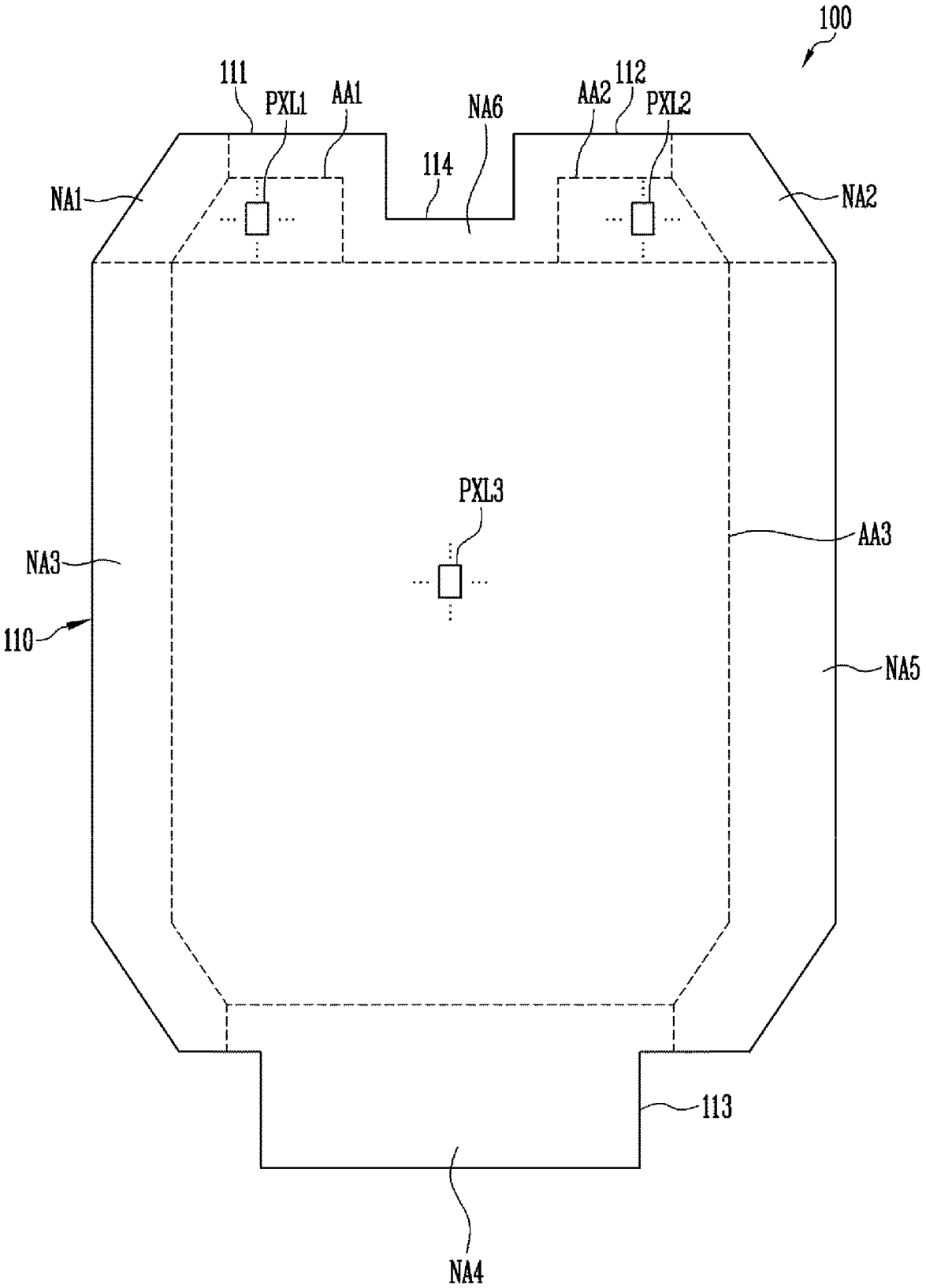
Figure 1C:
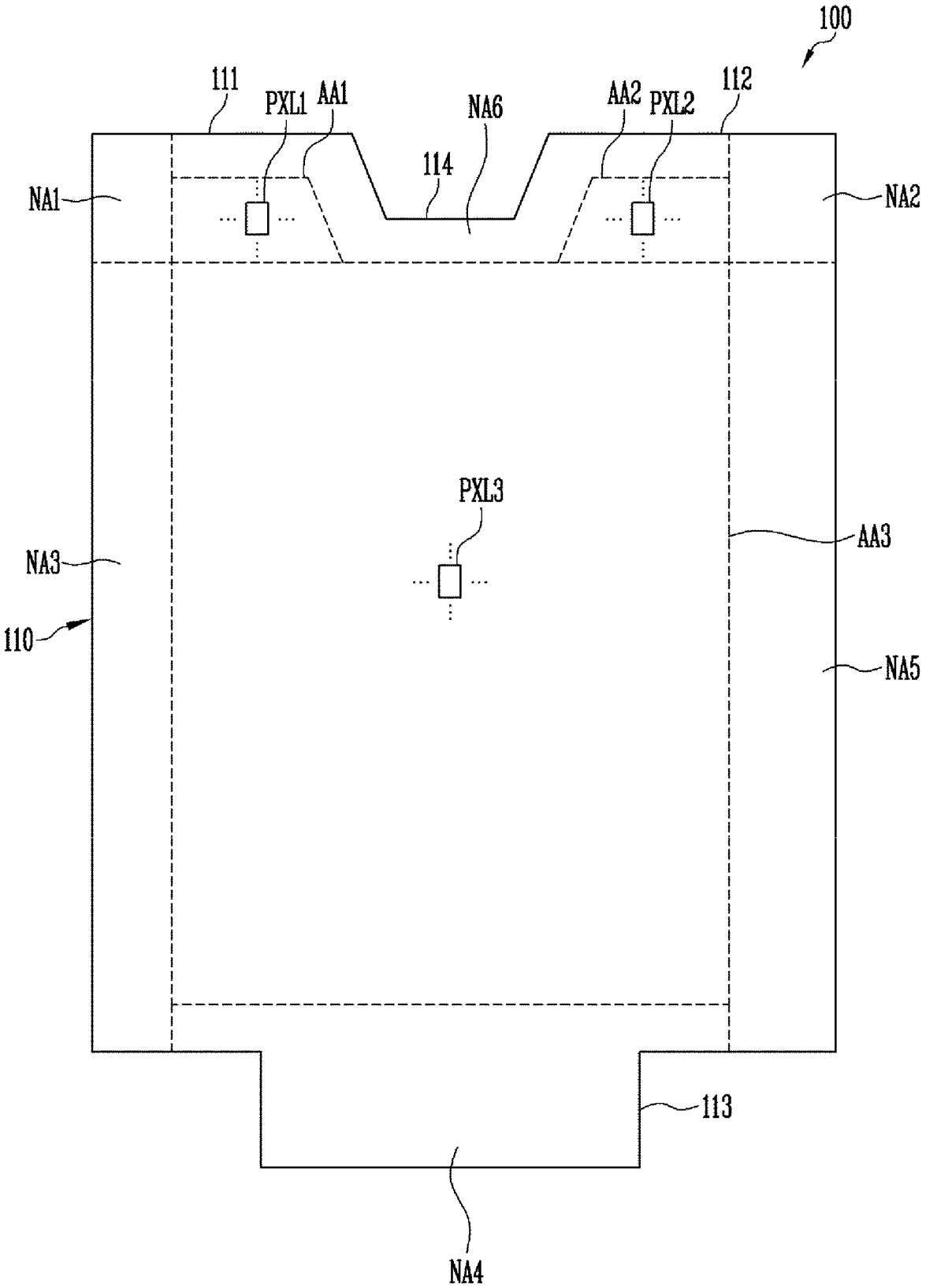
Figure 1D:
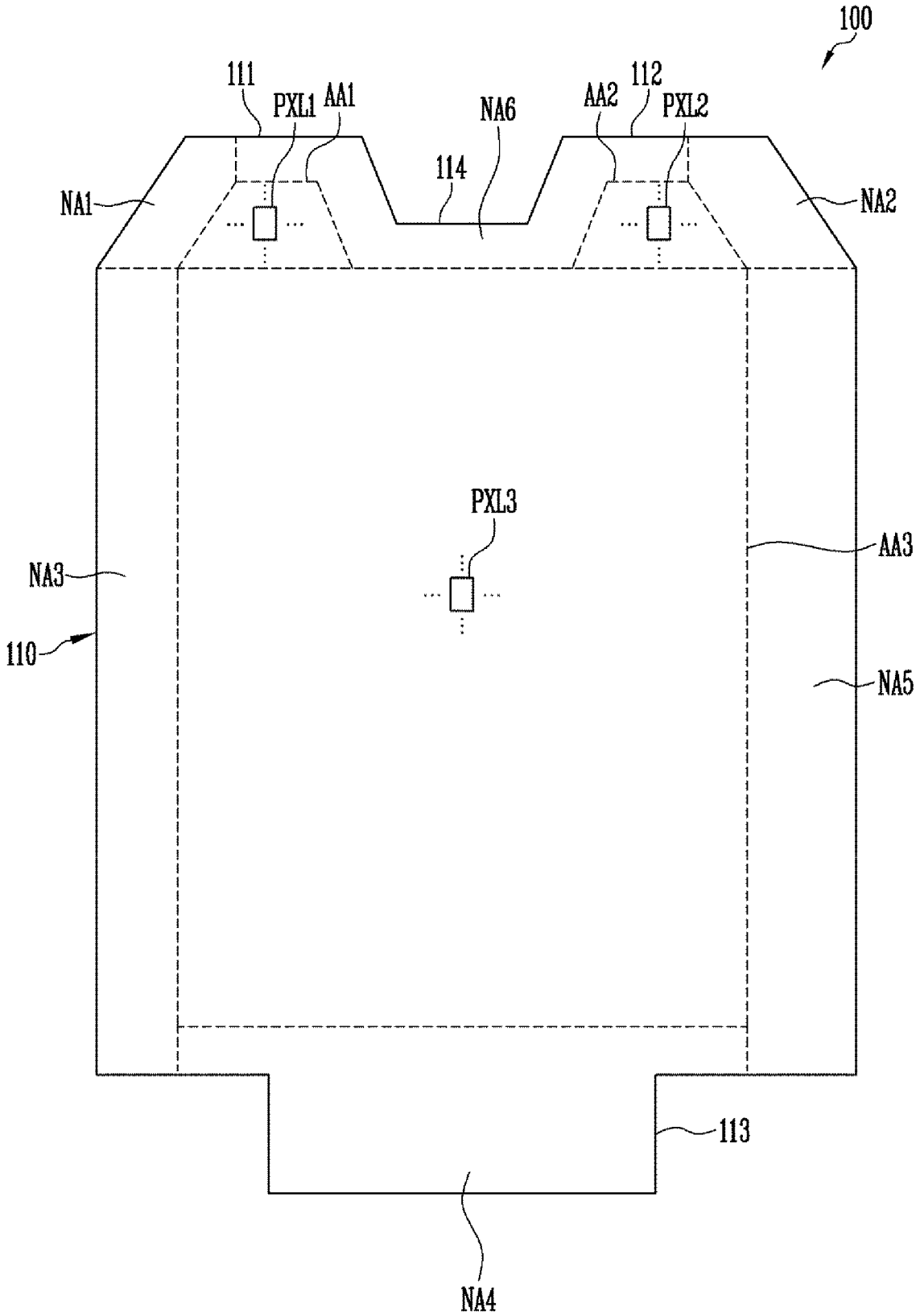

In addition, according to an embodiment, at least one of corners of the substrate 110, the first pixel area AA1, the second pixel area AA2 and/or the third pixel area AA3 may be changed to an inclined shape. For example, as shown in FIGS. 1B to 1D, at least one of the corners or sides of the substrate 110, the first pixel area AA1, the second pixel area AA2 and/or the third pixel area AA3 may be changed to the inclined shape. Although not shown, at least one of the corners of the substrate 110, the first pixel area AA1, the second pixel area AA2 and/or the third pixel area AA3 may be changed into a rounded shape.

Figure 1E:
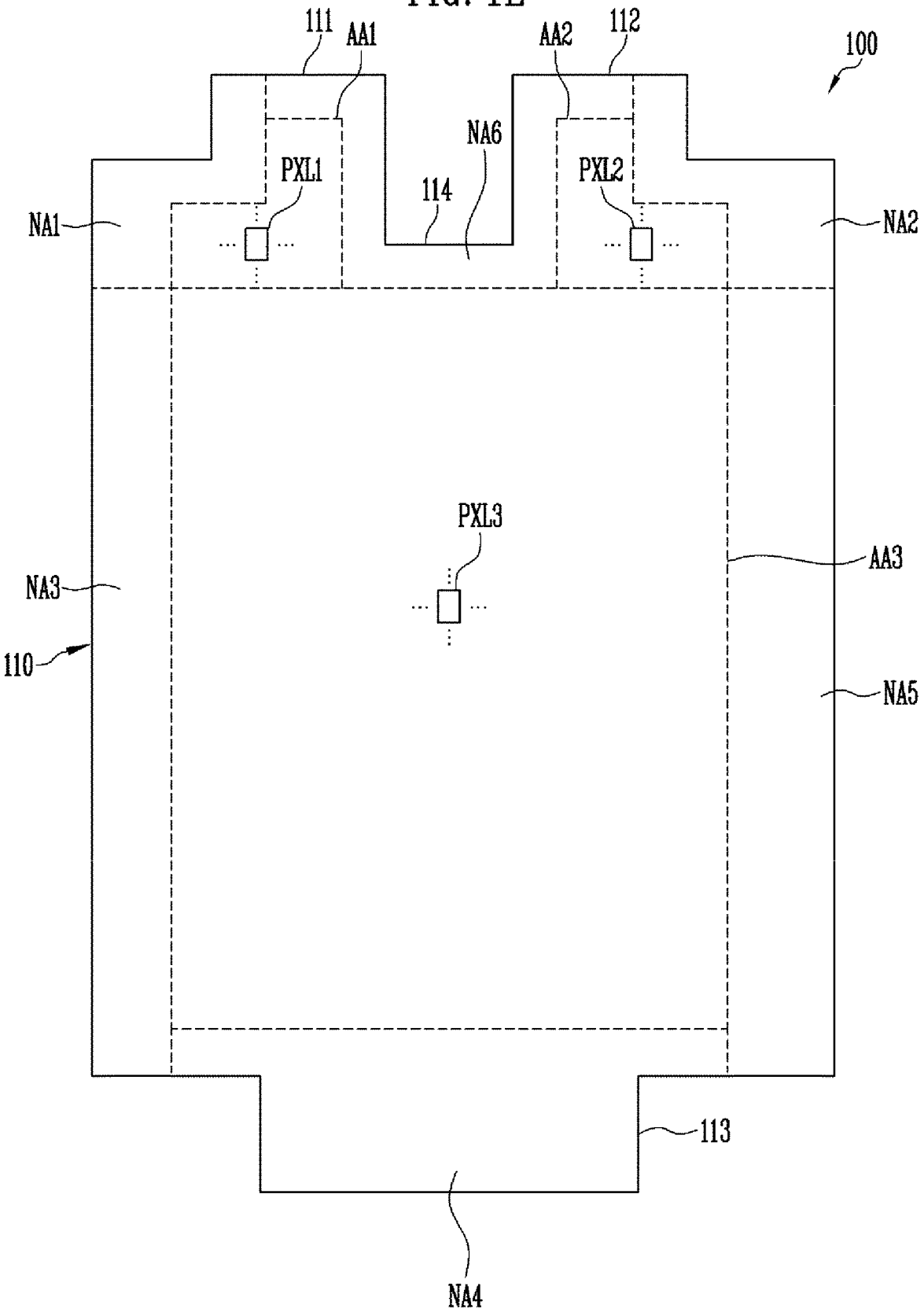

In addition, according to an embodiment, as shown in FIG. 1E, at least one of the substrate 110, the first pixel area AA1, the second pixel area AA2 and/or the third pixel area AA3, for example at least one corner of the first pixel area AA1 and the second pixel area AA2, may be changed into a step shape.

In addition, according to an embodiment, positions of the pixel areas AA1, AA2, and AA3 may be changed. For example, in FIGS. 1A to 1E, the first and second pixel areas AA1 and AA2 in which the scan lines, etc. are spaced apart from each other may be arranged above the third display area AA3 to all be arranged on one side of the display area. However, the positions of the first and second pixel areas AA1 and AA2 may also be changed in any other manner.

Figure 1F:
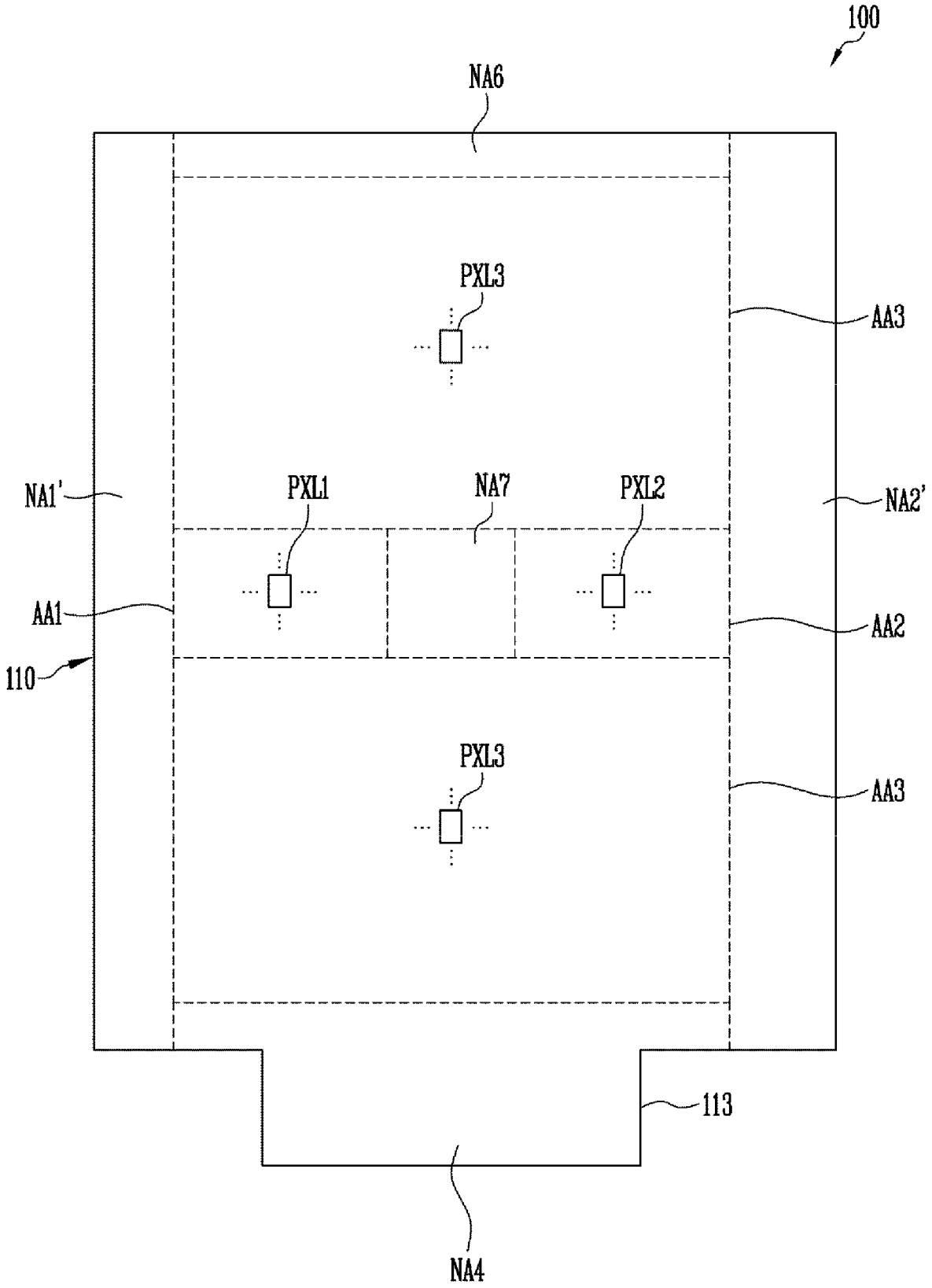

For example, as shown in FIG. 1F, the first and second pixel areas AA1 and AA2 may be arranged in the center section of the display area. For example, a seventh non-pixel area NA7 surrounded by the first, second and third pixel areas AA1, AA2 and AA3 may be arranged in the display area consisting of the first, second and third pixel areas AA1, AA2, and AA3. The first and second pixel areas AA1 and AA2 may be spaced apart from each other with the seventh non-pixel areas NA7 interposed therebetween. A pixel may not be arranged in the seventh non-pixel area NA7, and images are not displayed in the seventh non-pixel area NA7. According to an embodiment, the substrate 110 may be opened corresponding to the seventh non-pixel area NA7, or may not be opened.

According to an embodiment, at least portions of the first to sixth non-pixel areas NA1 to NA6 as shown in FIGS. 1A to 1E may be integrated or combined to form contiguous areas. For example, the first and third non-pixel areas NA1 and NA3 arranged on one side (for example, a left side) of the first and third pixel areas AA1 and AA3 in FIGS. 1A to 1E may be defined as an integrated first non-pixel area NA1' as shown in FIG. 1F. That is, the first non-pixel area NA1' may be defined by including the entire non-pixel area on the left side of the display device 100 according to an embodiment. In a similar way, the second and fifth non-pixel areas NA2 and NA5 arranged on another side (for example, a right side) of the second and third pixel areas AA2 and AA3 shown in FIGS. 1A to 1E, respectively, may be defined as an integrated second non-pixel area NA2' as shown in FIG. 1F. That is, the second non-pixel area NA2' may be defined by including a non-pixel area on the right side of the display device 100 according to an embodiment.

Additionally, the display device 100 according to an embodiment of the present disclosure may include at least two (here, four) pixel areas AA1, AA2 and/or AA3 separated from each other to be embodied as various shapes.

Figure 2A:
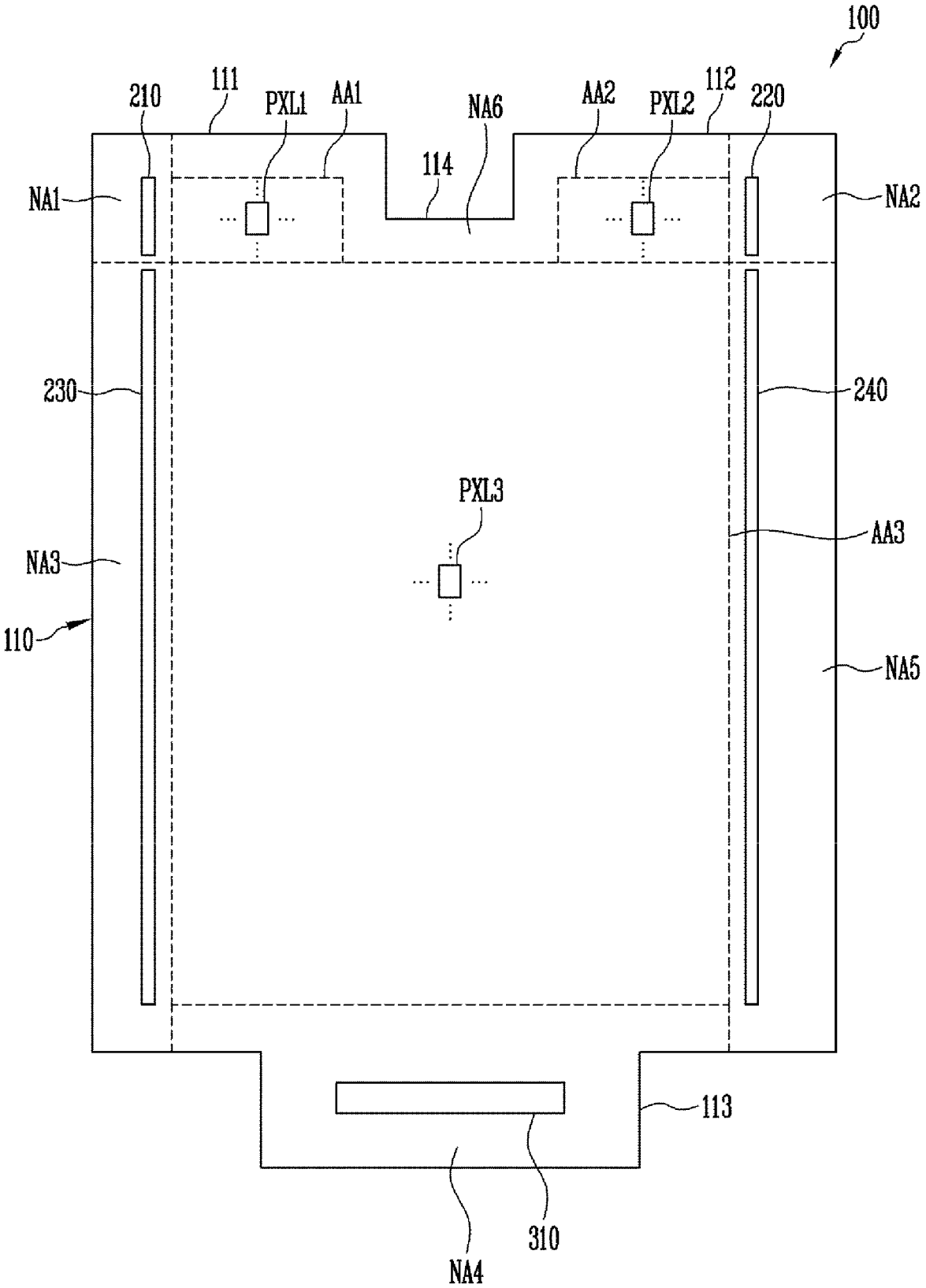
FIGS. 2A and 2B illustrate a display device according to an embodiment of the present disclosure.
Figure 2B:
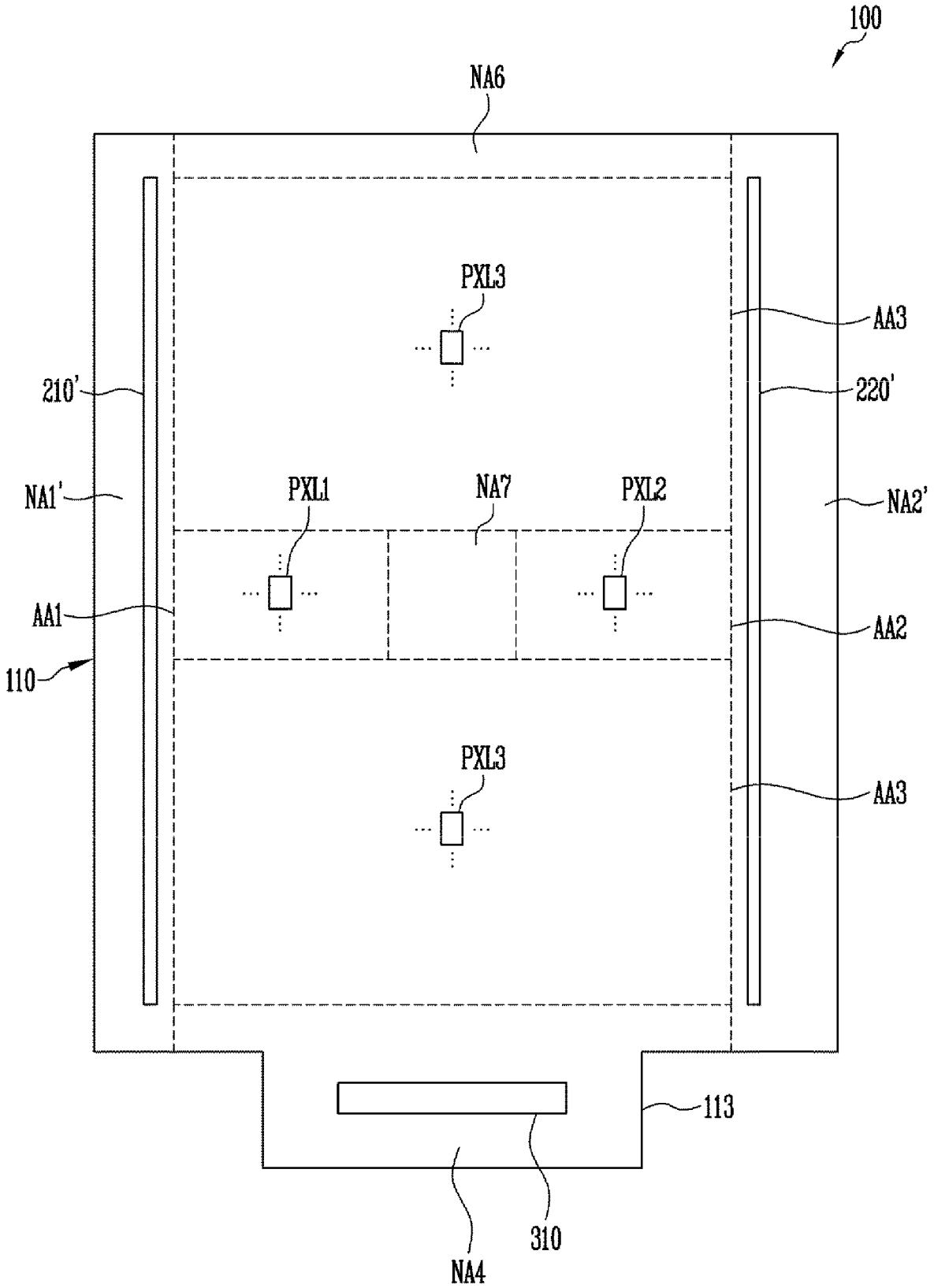

FIGS. 2A and 2B illustrate a display device according to an embodiment of the present disclosure. In FIGS. 2A and 2B, the same or similar constituent elements to those in FIG. 1 are denoted by the same reference numerals, and a detailed description thereof will be omitted.

Referring to FIG. 2A, the display device 100 according to an embodiment of the present disclosure may include at least two (here, four) scan drivers 210, 220, 230 and/or 240 arranged on the substrate 110. For example, the display device 100 may include a first scan driver 210 for driving the first pixels PXL1 in the first pixel area AA1 and a second scan driver 220 for driving the second pixels PXL2 in the second pixel area AA2. In addition, according to an embodiment, the display device 100 may include at least one scan driver (here, two) for driving the third pixels PXL3 in the third pixel area AA3, for example, at least one of a third scan driver 230 and a fourth scan driver 240. In addition, according to an embodiment, the display device 100 may further include a data driver 310 arranged on the substrate 110. In another embodiment, the data driver 310 may be mounted on a circuit board external to the substrate 110 and connected to the substrate 110.

According to an embodiment, the first scan driver 210 may be arranged at a periphery of the first pixel area AA1. For example, the first scan driver 210 may be arranged in the first non-pixel area NA1 at a periphery of the first pixel area AA1.

According to an embodiment, the second scan driver 220 may be arranged at a periphery of the second pixel area AA2. For example, the second scan driver 220 may be arranged at the second non-pixel area NA2 at a periphery of the second pixel area AA2.

According to an embodiment, the third scan driver 230 may be arranged at a periphery of the third pixel area AA3. For example, the third scan driver 230 may be arranged in the third non-pixel area NA3 at a periphery of the third pixel area AA3. According to an embodiment, one or more scan drivers and/or light emitting control drivers for driving the third pixel area AA3 may be arranged at a periphery of the third pixel area AA3. For example, the fourth scan driver 240 may be further provided in a position opposite to the third scan driver 230 with the third pixel area AA3 interposed in between. That is, the third pixel area AA3, having a relatively greater area than the first and second pixel areas AA1 and AA2, may be driven by two scan drivers 230 and 240 arranged on both sides of the third pixel area AA3.

According to an embodiment, the fourth scan driver 240 may be arranged at the periphery of the third pixel area AA3. For example, the fourth scan driver 240 may be arranged in the fifth non-pixel area NA5. According to an embodiment, the fifth non-pixel area NA5 may be opposite to the third non-pixel area NA3 with the third pixel area AA3 interposed in between. Although not shown, according to an embodiment, at least one light emitting control driver for driving the third pixel area AA3 may be arranged at the periphery of the third pixel area AA3.

According to an embodiment, the data driver 310 may be mounted on the substrate 110. For example, the data driver 310 may be mounted in the fourth non-pixel area NA4. However, the present disclosure is not limited thereto. For example, in another embodiment, the data driver 310 may be mounted on a circuit board which is not shown and electrically connected to the first pixel areas PXL1, the second pixels PXL2 and/or the third pixels PXL3 through data pads provided on the substrate 110.

FIG. 2A separately illustrates scan drivers 210, 220, 230 and 240 for driving each of the pixel areas AA1, AA2, and AA3. However, at least portions of the scan drivers 210, 220, 230 and 240 may be embodied as an integrated scan driver. For example, as shown in FIG. 2B, a first scan driver 210' for driving the first and third pixel areas AA1 and AA3 may be arranged on one side of the display device 100, and a second scan driver 220' for driving the second and third pixel areas AA2 and AA3 may be arranged on another side of the display device 100. According to an embodiment, in the first and second pixel areas AA1 and AA2 of FIG. 2B, the scan lines may be separated by the seventh non-pixel area NA7, so that the first and second pixel areas AA1 and AA3 may receive the scan signals from the first scan driver 210' and the second scan driver 220', respectively. In addition, the third pixel areas AA3 may concurrently receive the scan signals from both ends of the scan lines by the first and second scan drivers 210' and 220'.

Figure 3:
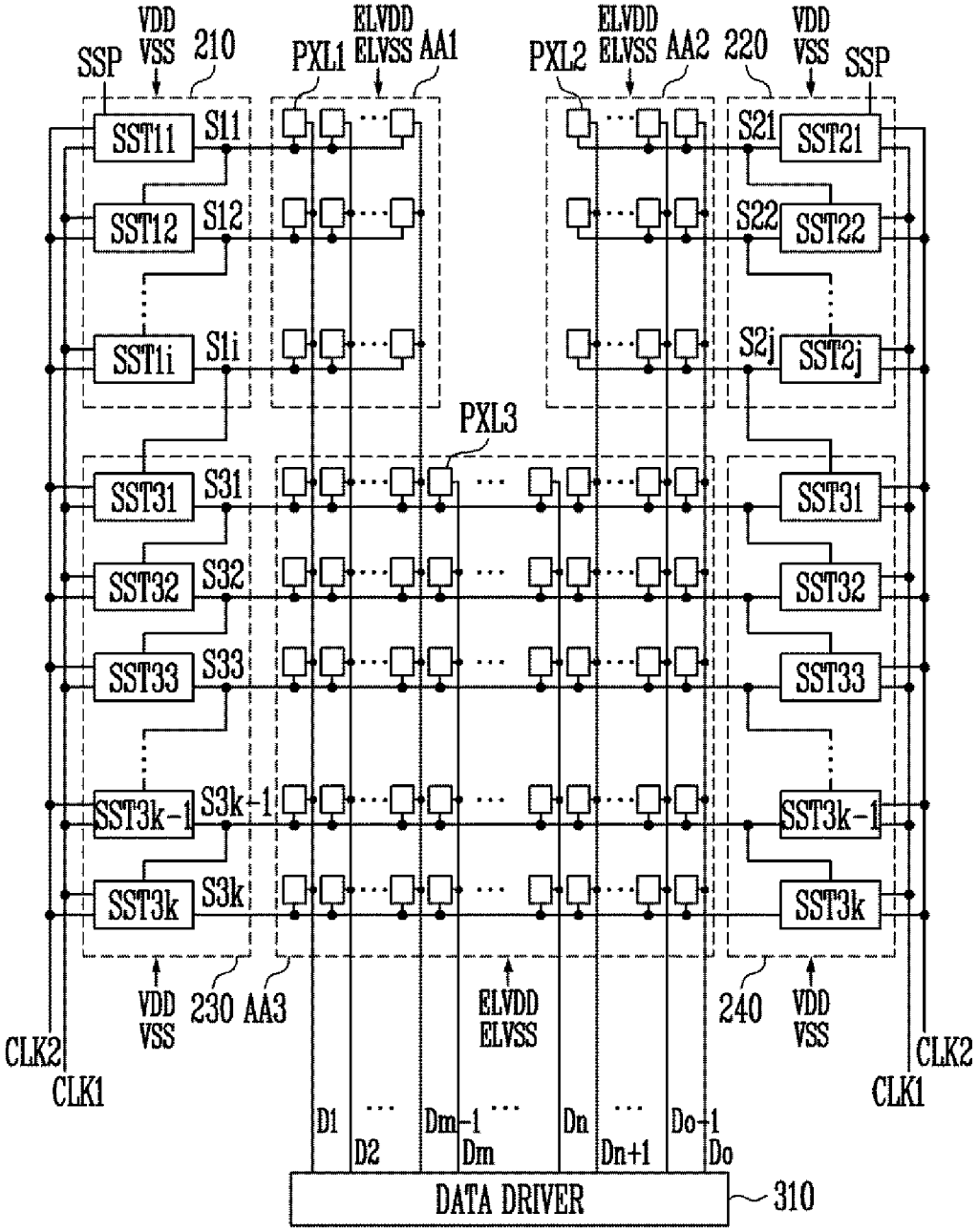
FIG. 3 illustrates an embodiment of each pixel area shown in FIG. 2A and a driver for driving the same.

FIG. 3 illustrates an embodiment of each pixel area shown in FIG. 2A and a driver for driving the same. For convenience of explanation, FIG. 3 illustrates an embodiment in which each scan driver is driven by two clock signals, but other structures and/or input signals of the scan driver may be employed.

Referring to FIG. 3, according to an embodiment, first scan lines S11 to S1*i* (i is a natural number), data lines D1 to Dm−1 (m is a natural number more than 2 (two)) and the first pixels PXL1 electrically connected to the first scan lines S11 to S1*i* and the data lines D1 to Dm−1 may be arranged in the first pixel area AA1. The first pixels PXL1 may emit light of predetermined brightness corresponding to scan signals supplied from the first scan driver 210 through the first scan lines S11 to S1*i* and data signals supplied from the data driver 310 through the data lines D1 to Dm−1.

According to an embodiment, the first pixels PXL1 may be driven by further receiving a first pixel power source ELVDD and a second pixel power source ELVSS. For example, when each of the first pixels PXL1 is a pixel of an organic light emitting display device including an organic light emitting diode (OLED), the first pixels PXL1 may further receive the first and second pixel power sources ELVDD and ELVSS. In addition, depending on pixel structure, the first pixels PXL1 may further receive a third pixel power supply, for example, an initial power supply Vinit.

In addition, the numbers of horizontal pixel lines (pixel rows) and vertical pixel lines (pixel columns), and the number of first pixels PXL1 arranged in each of horizontal pixel lines and/or vertical pixel lines positioned in the first pixel area AA1, are particularly limited. That is, the numbers of horizontal pixel lines and/or vertical pixel lines and the number of first pixels PXL1 arranged in the first pixel area AA1 may vary.

According to an embodiment, second scan lines S21 to S2*j* (j is a natural number), data lines Dn+1 to Do (n is a natural number and o is a natural number more than n+1) and second pixels PXL2 electrically connected to the second scan lines S21 to S2*j* and the data lines Dn+1 to Do may be arranged in the second pixel area AA2. The second pixels PXL2 may emit light of a predetermined brightness corresponding to scan signals supplied from the second scan driver 220 through the second scan lines S21 to S2*j* and data signals supplied from the data driver 310 through the data lines Dn+1 to Do.

In an embodiment of the present disclosure, the second pixel area AA2 may be arranged to be spaced apart from the first pixel area AA1. For example, the first pixel area AA1 and the second pixel area AA2 may be arranged next to each other to be spaced apart from each other by a predetermined distance along the longitudinal direction (e.g., a horizontal direction in the view of FIG. 3). In addition, the second scan lines S21 to S2*j* may be formed separately from the first scan lines S11 to S2*i*. In such a case, the scan signal from the first scan driver 210 may not be transmitted to the second pixel area AA2, and the scan signal from the second scan driver 220 may not be transmitted to the first pixel area AA1.

According to an embodiment, the second pixels PXL2 may be driven by further receiving the first and second pixel power sources ELVDD and ELVSS. For example, when each of the second pixels PXL2 is an organic light emitting display device including an organic light emitting diode (OLED), the second pixels PXL2 may further receive the first and second pixel power sources ELVDD and ELVSS. In addition, depending on pixel structure, the second pixels PXL2 may be further supplied with the third pixel power supply, for example, the initial power supply Vinit.

In addition, the numbers of horizontal pixel lines (pixel rows) and vertical pixel lines (pixel columns) and the number of second pixels PXL2 arranged in each of horizontal pixel lines and/or vertical pixel lines positioned in the second pixel area AA2 may vary. For example, the same numbers of horizontal pixel lines, vertical pixel lines and second pixels PXL2 as those of the first pixel area AA1 may be arranged in the second pixel area AA2, but the present disclosure is not limited thereto. In other words, the numbers of horizontal pixel lines, vertical pixel lines and/or second pixels PXL2 arranged at each pixel line in the second pixel area AA2 may vary.

According to an embodiment, third scan lines S31 to S3*k* (k is a natural number), data lines D1 to Do, and third pixels PXL3 electrically connected to the third scan lines S31 to S3*k* and the data lines D1 to Do, may be positioned in the third pixel area AA3. The third pixels PXL3 may emit light of a predetermined brightness corresponding to scan signals supplied from third and/or fourth scan drivers 230 and 240 through the third scan lines S31 to S3*k*, and data signals supplied from the data driver 310 through the data lines D1 to Do.

According to an embodiment, the third pixels PXL3 may be further supplied with the first and second pixel power sources ELVDD and ELVSS. For example, when each of the third pixels PXL3 is an organic light emitting display device including an organic light emitting diode (OLED), the third pixels PXL3 may be further supplied with the first and second pixel power sources ELVDD and ELVSS. In addition, depending on a pixel structure, the third pixels PXL3 may be further supplied with the third pixel power supply, for example, the initial power supply Vinit.

Further, the numbers of horizontal pixel lines (pixel rows) and vertical pixel lines (pixel columns), and the number of third pixels PXL3 arranged in each of the horizontal pixel lines and/or the vertical pixel lines positioned in the third pixel area AA3, are not particularly limited. For example, greater numbers of horizontal pixel lines, vertical pixel lines, and third pixels PXL3 may be disposed in the third pixel area AA3 than those of the first and second pixel areas AA1 and AA2, but the present disclosure is not limited thereto. That is, the numbers of horizontal pixels, vertical pixels, and/or third pixels PXL3 arranged at each pixel line disposed in the third pixel area AA3 may vary. In order to prevent delay of the scan signals, the third pixels PXL3 may receive a third scan signal from the third and fourth scan drivers 230 and 240 through both ends of the third scan lines S31 to S3*k*. However, the present disclosure is not limited thereto. For example, the third pixels PXL3 may be driven by a single scan driver in another embodiment.

Light emitting control lines which are not shown may be further arranged in the first pixel area AA1, the second pixel area AA2, and/or the third pixel area AA3 according to the structures (or configuration) of the first pixels PXL1, the second pixels PXL2, and/or the third pixels PXL3. In such a case, the display device 100 may further include one or more light emitting control drivers or the like. In an embodiment of the present disclosure, the structures of the pixels PXL1, PXL2 and PXL3 are not particularly limited, and pixels of any known structure or type may be applied. Therefore, a detailed description of the structure of each of the pixels PXL1, PXL2, and PXL3 will be omitted.

According to an embodiment, the first scan driver 210 may be located in the first non-pixel area NA1 in the periphery of the first pixel area AA1. The first scan driver 210 may be electrically connected to the first scan lines S11 to S1*i*. The first scan driver 210 may generate scan signals corresponding to scan control signals externally input, for example a start pulse SSP and clock signals CLK1 and CLK2, and output the generated scan signal to the first scan lines S11 to S1*i*.

To this end, the first scan driver 210 may include a plurality of scan stage circuits SST11 to SST1*i*. The scan stage circuits SST11 to SST1*i* of the first scan driver 210 may be electrically connected to the first scan lines S11 to S1*i* to supply first scan signals to the first scan lines S11 to S1*i*.

According to an embodiment, the scan stage circuits SST11 to SST1*i* may operate corresponding to first and second clock signals CLK1 and CLK 2 supplied from an external source. In addition, the scan stage circuits SST11 to SST1*i* may be driven by receiving an output signal of a previous single scan stage circuit (i.e., a previous stage scan signal) or the start pulse SSP. For example, the first scan stage circuit SST11 may be supplied with the start pulse SSP and the remaining scan stage circuits SST12 to SST1*i* may be supplied with the output signal of the previous single stage circuit. According to an embodiment, each of the scan stage circuits SST11 to SST1*i* may be embodied as substantially the same circuit, i.e. each may have the same layout.

In addition, the scan stage circuits SST11 to SST1*i* may be driven by receiving a first driving power supply VDD and a second driving power supply VSS, respectively. According to an embodiment, the first driving power supply VDD may be set to a gate off voltage, for example, a high level voltage. Further, the second driving power supply VSS may be set to a gate on voltage, for example, a low level voltage.

According to an embodiment, the second scan driver 220 may be located in the second non-pixel area NA2 at the periphery of the second pixel area AA2. The second scan driver 220 may be electrically connected to the second scan lines S21 to S2*j*. The second scan driver 220 may generate scan signals corresponding to the scan control signals input from an external source, for example the start pulse SSP and the clock signals CLK1 and CLK2, and output the generated scan signal to the scan lines S21 to S2*j*.

To this end, the second scan driver 220 may include a plurality of scan stage circuits SST21 to SST2*j*. The scan stage circuits SST21 to SST2*j* of the second scan driver 220 may be electrically connected to the second scan lines S21 to S2*j* to supply second scan signals to the second scan lines S21 to S2*j*.

According to an embodiment, the scan stage circuits SST21 to SST2*j* of the second scan driver 220 may be driven by receiving the first and second clock signals CLK1 and CLK2 supplied from an external source, the output signal of the previous single scan stage circuit (i.e., a previous stage scan signal) or the start pulse SSP. According to an embodiment, the scan stage circuits SST21 to SST2*j* of the second scan driver 220 may be embodied as substantially the same circuit as the scan stage circuits SST11 to SST1*i* of the first scan driver 210. Therefore, detailed description thereof will be omitted.

According to an embodiment, the third scan driver 230 may be located in the third non-pixel area NA3 at the periphery of the third pixel area AA3. In addition, according to an embodiment, the fourth scan driver 240 may be further provided in a fifth non-pixel area NA5 at a periphery of the third pixel area AA3. The third and fourth scan drivers 230 and 240 may be electrically connected to the third scan lines S31 to S3*k*. The third and fourth scan drivers 230 and 240 may generate scan signals corresponding to the scan control signals input from an external source such as the output signals from each of the first and second scan drivers 210 and 220 (or, a start pulse SSP) and the clock signals CLK1 and CLK2, and output the generated scan signals to the third scan lines S31 to S3*k*.

To this end, each of the third and fourth scan drivers 230 and 240 may include a plurality of scan stage circuits SST31 to SST3*k*. The scan stage circuits SST31 to SST3*k* of the third and fourth scan drivers 230 and 240 may be electrically connected to the third scan lines S31 to S3*k* to supply the third scan signal to the third scan lines S31 to S3*k*.

According to an embodiment, the scan stage circuits SST31 to SST3*k* of the third and fourth scan drivers 230 and 240 may be driven by receiving the first and second clock signals CLK1 and CLK2 supplied from an external source, the output signal of the previous single scan stage circuit (i.e., a previous stage scan signal) or the start pulse SSP. For example, the first scan stage circuits SST31 of the third and fourth scan drivers 230 and 240 may use a signal output from the last scan stage circuit SST1*i* or SST2*j* of the first scan driver 210 or the second scan driver 220 as the start pulse SSP. Alternatively, in another embodiment, the first scan stage circuit SST31 of the third and fourth scan drivers 230 and 240 may be supplied with a separate start pulse.

The remaining scan stage circuits SST32 to SST3*k* of the third and fourth scan drivers 230 and 240 may receive the output signal of the previous single stage circuit. According to an embodiment, the scan stage circuits SST31 to SST3*k* of the third and fourth scan drivers 230 and 240 may be embodied as substantially the same circuit, i.e. may have substantially the same layout.

According to an embodiment, the scan stage circuits SST31 to SST3*k* of the third and fourth scan drivers 230 and 240 may be embodied as substantially the same circuit as the scan stage circuits SST11 to SST1*i* and/or SST21 to SST2*j* of the first and/or second scan drivers 210 and 220. Therefore, detailed description thereof will be omitted.

Figure 4:
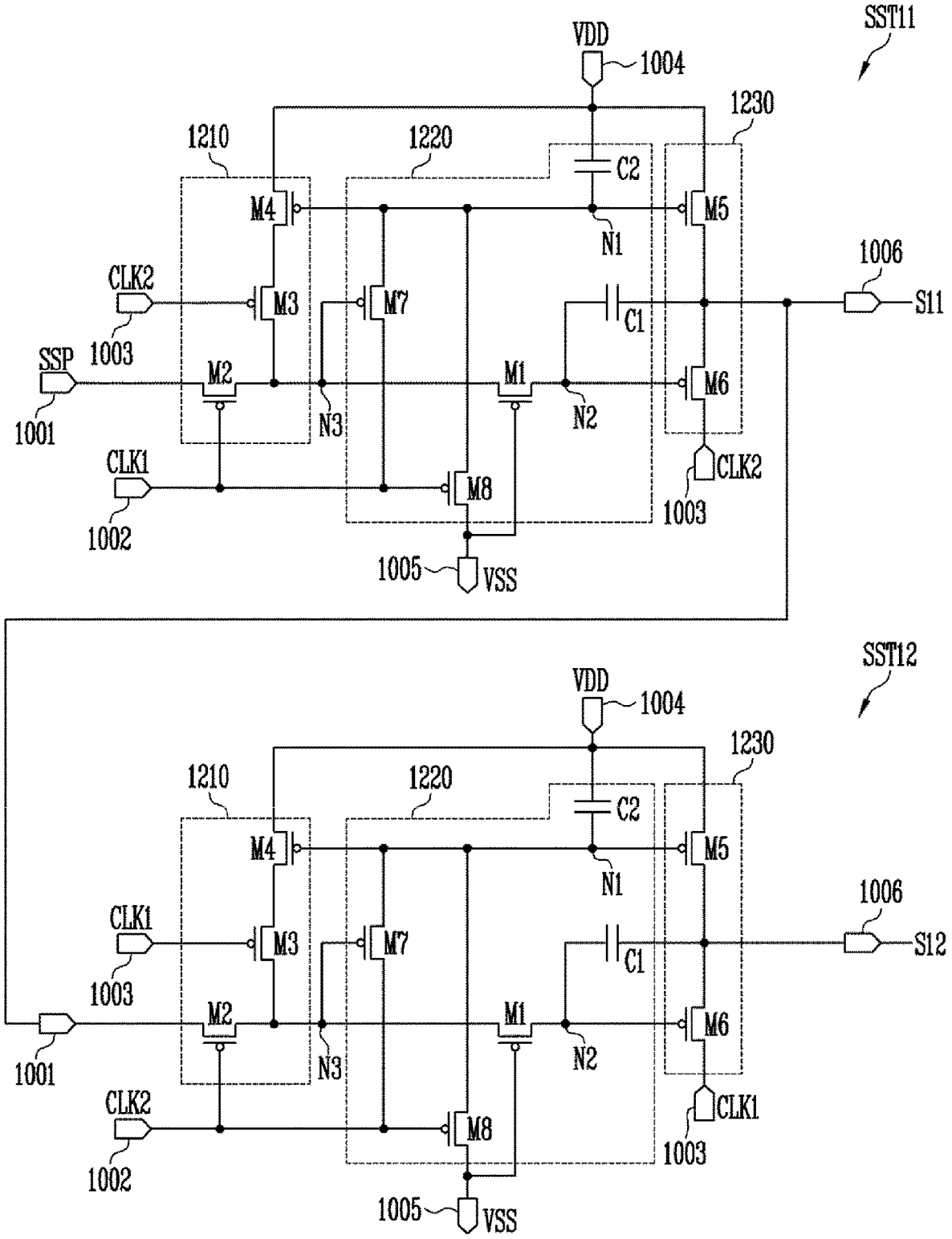
FIG. 4 illustrates an embodiment of a scan stage circuit shown in FIG. 3.

FIG. 4 illustrates an embodiment of a scan stage circuit shown in FIG. 3. For convenience of explanation, a scan stage circuit of the first scan driver will be shown in FIG. 4.

Referring to FIG. 4, a first scan stage circuit SST11 may include a first driving circuit 1210, a second driving circuit 1220, and an output unit 1230.

The output unit 1230 may control a voltage of an output signal output to an output terminal 1006 corresponding to voltages of a first node N1 and a second node N2. To this end, the output unit 1230 may include a fifth transistor M5 and a sixth transistor M6.

The fifth transistor M5 may be connected between a fourth input terminal 1004 to which the first driving power supply VDD is input, and the output terminal 1006. A gate electrode thereof may be connected to the first node N1. Such a fifth transistor M5 may control the connection between the fourth input terminal 1004 and the output terminal 1006 according to a voltage applied to the first node N1.

The sixth transistor M6 may be connected between the output terminal 1006 and a third input terminal 1003, and a gate electrode thereof may be connected to the second node N2. Such a sixth transistor M6 may control the connection between the output terminal 1006 and the third input terminal 1003 according to the voltage applied to the second node N2.

The output unit 1230 may be driven as a buffer. Additionally, the fifth transistor M5 and/or the sixth transistor M6 may consist of a plurality of transistors connected in parallel.

The first driving circuit 1210 may control the voltage of the third node N3 corresponding to input signals supplied to a first input terminal 1001, a second input terminal 1002, and the third input terminal 1003. To this end, the first driving circuit 1210 may include a second transistor M2, a third transistor M3 and a fourth transistor M4.

The second transistor M2 may be connected between the first input terminal 1001 and the third node N3, and a gate electrode thereof may be connected to the second input terminal 1002. Accordingly, the second transistor M2 may control the connection between the first input terminal 1001 and the third node N3 by a signal supplied to the second input terminal 1002.

The third transistor M3 and the fourth transistor M4 may be connected in series between the third node N3 and the fourth input terminal 1004. The third transistor M3 may be connected between the fourth transistor M4 and the third node N3, and a gate electrode thereof may be connected to the third input terminal 1003. Thus, the third transistor M3 may control the connection between the fourth transistor M4 and the third node N3 according to a signal supplied to the third input terminal 1003.

The fourth transistor M4 may be connected between the third transistor M3 and the fourth input terminal 1004, and a gate electrode thereof may be connected to the first node N1. The fourth transistor M4 may thus control the connection between the third transistor M3 and the fourth input terminal 1004 according to the voltage of the first node N1.

The second driving circuit 1220 may control the voltage of the first node N1, according to the voltages of the second input terminal 1002 and the third node N3. To this end, the second driving circuit 1220 may include a first transistor M1, a seventh transistor M7, an eighth transistor M8, a first capacitor C1 and a second capacitor C2.

The first capacitor C1 may be connected between the second node N2 and the output terminal 1006. The first capacitor C1 may charge the voltage corresponding to turn-on and turn-off states of the sixth transistor M6.

The second capacitor C2 may be connected between the first node N1 and the fourth input terminal 1004. The second capacitor C2 may charge the voltage applied to the first node N1.

The seventh transistor M7 may be connected between the first node N1 and the second input terminal 1002, and a gate electrode thereof may be connected to the third node N3. The seventh transistor M7 may thereby control the connection between the first node N1 and the second input terminal 1002 according to the voltage of the third node N3.

The eighth transistor M8 may be located between the first node N1 and a fifth input terminal 1005 to which the second driving power supply VSS is supplied, and a gate electrode thereof may be connected to the second input terminal 1002. The eighth transistor M8 may thus control the connection between the first node N1 and the fifth input terminal 1005 according to a signal from the second input terminal 1002.

The first transistor M1 may be connected between the third node N3 and the second node N2, and a gate electrode thereof may be connected to the fifth input terminal 1005. The first transistor M1 may maintain the electrical connection between the third node N3 and the second node N2 when in its on state. In addition, the first transistor M1 may limit a voltage drop width of the third node N3 due to the voltage of the second node N2. In other words, even though the voltage of the second node N2 falls to a voltage lower than the second driving power supply VSS, the voltage of the third node N3 may not be lower than a voltage obtained by subtracting a threshold voltage of the first transistor M1 from the second driving power supply VSS.

The second scan stage circuit SST12 and the remaining scan stage circuits SST13 to SST1*i* may have substantially the same configuration as the first scan stage circuit SST11.

According to an embodiment, portions of the scan stage circuits SST11 to SST1*i* may receive the first clock signal CLK1 and the second clock signal CLK2 through the second input terminal 1002 and the third input terminal 1003 respectively, and the remainder may receive the second clock signal CLK2 and the first clock signal CLK1 through the second input terminal 1002 and the third input terminal 1003 respectively. For example, odd-numbered scan stage circuits SST11, SST13, etc. may receive the first clock signal CLK1 and the second clock signal CLK2 through the second input terminal 1002 and the third input terminal 1003 respectively, and even-numbered scan stage circuits SST12, SST14, etc. may receive the second clock signal CLK2 and the first clock signal CLK1 through the second input terminal 1002 and the third input terminal 1003 respectively.

According to an embodiment, the first clock signal CLK1 and the second clock signal CLK2 may have the same periods and the phases thereof do not overlap with each other. For example, when a period in which a scan signal is supplied to a single first scan line is designated as one horizontal period (1H), each of the clock signals CLK1 and CLK2 may have a period of 2H and be supplied in different horizontal periods.

Although the scan stage circuit included in the first scan driver 210 has been described with reference to FIG. 4, scan stage circuits included in scan drivers other than the first scan driver 210, for example the second scan driver 220, the third scan driver 230 and/or the fourth scan driver 240, may have substantially the same configuration.

Figure 5:
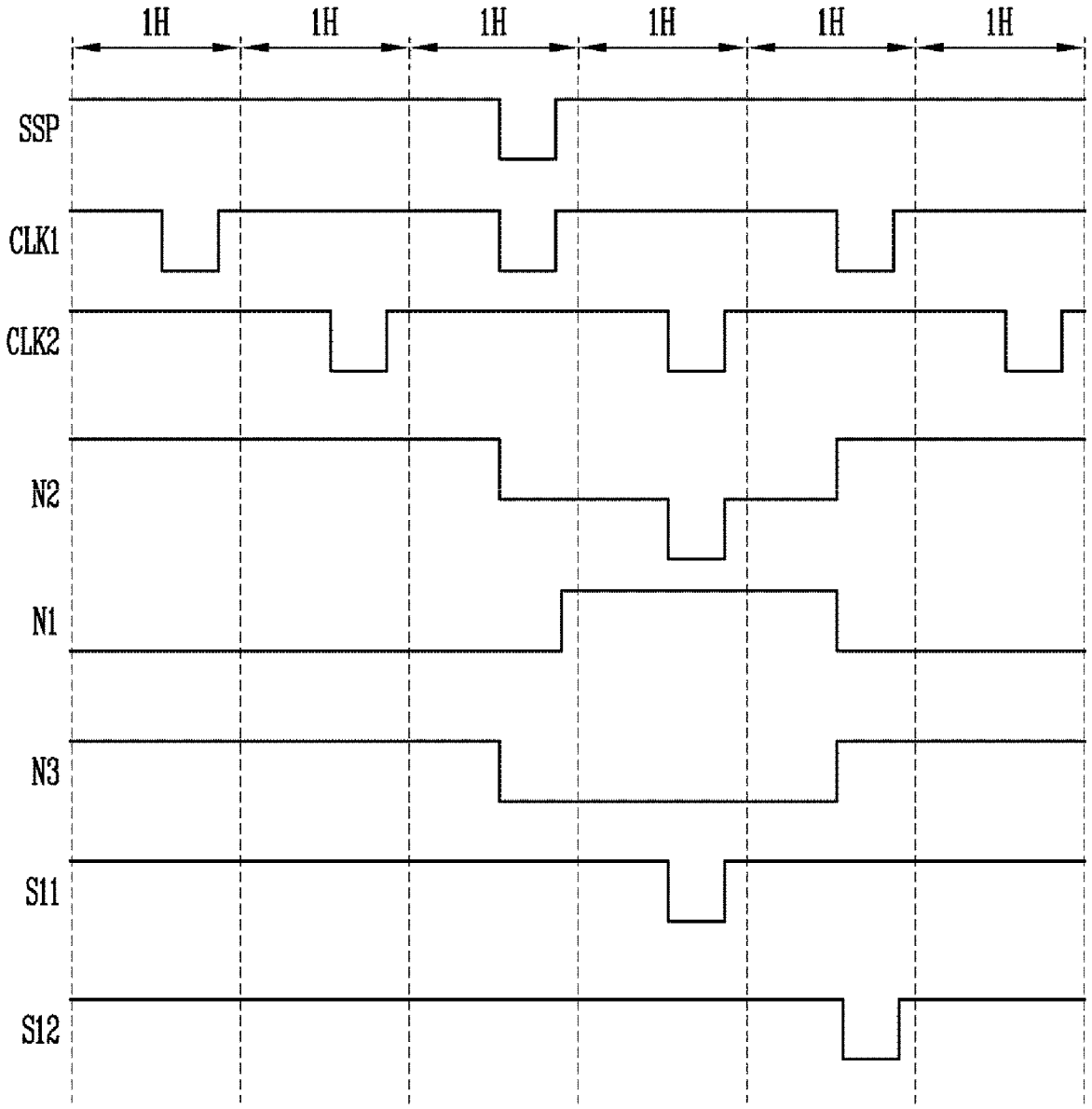
FIG. 5 is a waveform view illustrating a driving method for the scan stage circuit shown in FIG. 4.

FIG. 5 is a waveform view illustrating a driving method for the scan stage circuit shown in FIG. 4. For convenience, an operation process will be described with reference to the first scan stage circuit SST11 in FIG. 5.

Referring to FIG. 5, the first clock signal CLK1 and the second clock signal CLK2 may each have a two (2) horizontal period (2H) cycle and be supplied in different horizontal periods from each other. In other words, the second clock signal CLK2 may be set to a signal shifted from the first clock signal CLK1 by half a cycle (i.e., one horizontal period 1H). In addition, the start pulse SSP supplied to the first input terminal 1001 may be supplied to be synchronized with the clock signal supplied to the second input terminal 1002, that is, the first clock signal CLK1.

In addition, when the start pulse SSP is supplied, the first input terminal 1001 may be set to the voltage of the second driving power supply VSS, and when the start pulse SSP is not supplied, the first input terminal 1001 may be set to the voltage of the first driving power supply VDD. When the clock signals CLK1 and CLK2 are supplied to the second input terminal 1002 and the third input terminal 1003, the second input terminal 1002 and the third input terminal 1003 may be set to the voltage of the second driving power supply VSS, and when the clock signals CLK1 and CLK2 are not supplied, the second input terminal 1002 and the third input terminal 1003 may be set to the voltage of the first driving power supply VDD.

The operation process is described below in more detail. First, the start pulse SSP may be supplied so as to be synchronized with the first clock signal CLK1.

When the first clock signal CLK1 is supplied, the second transistor M2 and the eighth transistor M8 may be turned on. When the second transistor M2 is turned on, the first input terminal 1001 and the third node N3 may be electrically connected. Since the first transistor M1 is set to the turn-on state, the second node N2 may maintain electrical connection with the third node N3.

When the first input terminal 1001 and the third node N3 are electrically connected to each other, the third node N3 and the second node N2 may be set to a low level voltage by the start pulse SSP supplied to the first input terminal 1001. When the third node N3 and the second node N2 are set to the low level voltage, the sixth transistor M6 and the seventh transistor M7 may be turned on.

When the sixth transistor M6 is turned on, the third input terminal 1003 and the output terminal 1006 may be electrically connected. The third input terminal 1003 may be set to a high level voltage (i.e., the second clock signal CLK2 is not supplied), and the high level voltage may be output to the output terminal 1006 accordingly. When the seventh transistor M7 is turned on, the second input terminal 1002 and the first node N1 may be electrically connected. Therefore, the voltage of the first clock signal CLK1 supplied to the second input terminal 1002, that is, the low level voltage, may be supplied to the first node N1.

In addition, the eighth transistor M8 may be turned on when the first clock signal CLK1 is supplied. When the eighth transistor M8 is turned on, the voltage of the second driving power supply VSS may be supplied to the first node N1. The voltage of the second driving power supply VSS may be set to the same or similar voltage as the first clock signal CLK1, so that the first node N1 may stably maintain the voltage at a low level.

When the first node N1 is set to the low level voltage, the fourth transistor M4 and the fifth transistor M5 may be turned on. When the fourth transistor M4 is turned on, the fourth input terminal 1004 and the third transistor M3 may be electrically connected. Since the third transistor M3 is set in the turn-off state, the third node N3 may stably maintain the voltage at a low level although the fourth transistor M4 is turned on.

When the fifth transistor M5 is turned on, the voltage of the first driving power supply VDD may be supplied to the output terminal 1006. The voltage of the first driving power supply VDD may be set to the same voltage as the high level voltage supplied to the third input terminal 1003, so that the output terminal 1006 may stably maintain the voltage at a high level.

Subsequently, the supply of the first start signal SSP and the first clock signal CLK1 may be stopped. When the supply of the first clock signal CLK1 is stopped, the second transistor M2 and the eighth transistor M8 may be turned off. The sixth transistor M6 and the seventh transistor M7 may maintain the turn-on state corresponding to the voltage stored in the first capacitor C1. That is, the second node N2 and the third node N3 may maintain the voltage at a low level by the voltage stored in the first capacitor C1.

When the sixth transistor M6 maintains the turn-on state, the output terminal 1006 and the third input terminal 1003 may maintain electrical connection. The first node N1 may maintain electrical connection with the second input terminal 1002 when the seventh transistor M7 maintains the turn-on state. The voltage of the second input terminal 1002 may be set to the high level voltage corresponding to the interruption of the supply of the first clock signal CLK1, so that the first node N1 may also be set to the high level voltage. When the high level voltage is supplied to the first node N1, the fourth transistor M4 and the fifth transistor M5 may be turned off.

Thereafter, the second clock signal CLK2 may be supplied to the third input terminal 1003. Since the sixth transistor M6 is set in the turn-on state, the second clock signal CLK2 supplied to the third input terminal 1003 may be supplied to the output terminal 1006. The output terminal 1006 may output the second clock signal CLK2 to the first scan line S11 as a scan signal.

When the second clock signal CLK2 is supplied to the output terminal 1006, the voltage of the second node N2 may be reduced to a lower voltage than the second driving power supply VSS by the coupling of the first capacitor C1, so that the sixth transistor M6 may stably maintain the turn-on state.

Although the voltage of the second node N2 is reduced, the third node N3 may substantially maintain the voltage of the second driving power supply VSS (a voltage obtained by subtracting the threshold voltage of the first transistor M1 from the second driving power supply VSS) by the first transistor M1.

After the scan signal is output to the first scan line S11, the supply of the second clock signal CLK2 may be stopped. When the supply of the second clock signal CLK2 is interrupted, the output terminal 1006 may output the high level voltage. The voltage of the second node N2 may rise to the voltage of the second driving power supply VSS corresponding to the high level voltage of the output terminal 1006.

The first clock signal CLK1 may be supplied. When the first clock signal CLK1 is supplied, the second transistor M2 and the eighth transistor M8 may be turned on. When the second transistor M2 is turned on, the first input terminal 1001 and the third node N3 may be electrically connected. The start pulse SSP may not be supplied to the first input terminal 1001 at that time, so that the first input terminal 1001 may be set to the high level voltage. Accordingly, when the first transistor M1 is turned on, the high level voltage may be supplied to the third node N3 and the second node N2, so that the sixth transistor M6 and the seventh transistor M7 may be turned off.

When the eighth transistor M8 is turned on, the second driving power supply VSS may be supplied to the first node N1, so that the fourth transistor M4 and the fifth transistor M5 may be turned on. When the fifth transistor M5 is turned on, the voltage of the first driving power supply VDD may be supplied to the output terminal 1006. The fourth transistor M4 and the fifth transistor M5 may maintain their turned-on state in response to the voltage charged in the second capacitor C2, so that the output terminal 1006 may be stably supplied with the voltage of the first driving power supply VDD.

Additionally, the third transistor M3 may be turned on when the second clock signal CLK2 is supplied. Since the fourth transistor M4 is set to the turn-on state, the voltage of the first driving power supply VDD may also be supplied to the third node N3 and the second node N2. The sixth transistor M6 and the seventh transistor M7 may thus stably maintain their off states.

The second scan stage circuit SST12 may be supplied with the output signal (that is, a scan signal) of the first scan stage circuit SST11 so as to be synchronized with the second clock signal CLK2. The second scan stage circuit SST12 may output a scan signal to a second first scan line S12 in synchronization with the first clock signal CLK1. The scan stage circuits SST of the present disclosure may sequentially output the scan signals to the scan lines while repeating the above-described process.

The first transistor M1 may limit a voltage drop width of the third node N3 regardless of the voltage of the second node N2. As a result, the manufacturing cost and the driving reliability may be secured.

Figure 6:
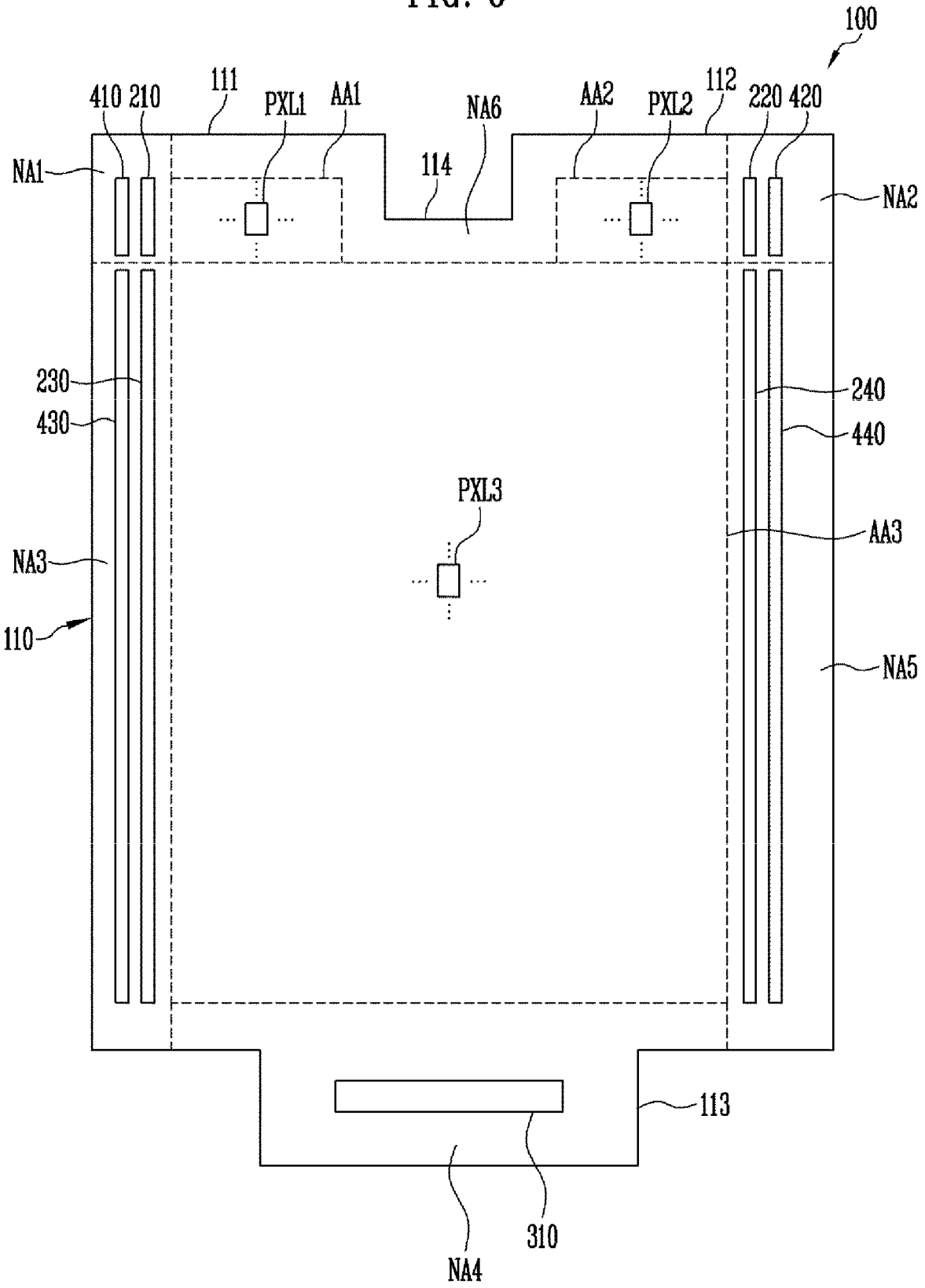
FIG. 6 illustrates a display device according to another embodiment of the present disclosure.

FIG. 6 illustrates a display device according to another embodiment of the present disclosure. For convenience, FIG. 6 illustrates a modified embodiment with regard to the embodiment of FIGS. 1A and 2A, but the embodiment features of FIG. 6 may also be applied to the embodiments shown in FIGS. 1B to 1F and 2B. In FIG. 6, the same or similar constituent elements to those in FIGS. 1A and 2A are denoted by the same reference numerals, and a detailed description thereof will be omitted.

Referring to FIG. 6, the display device 100 according to another embodiment of the present disclosure may further include light emitting control drivers for controlling light emitting periods of the pixels PXL1, PXL2, and PXL3. For example, a first light emitting control driver 410, a second light emitting control driver 420, a third light emitting control driver 430, and a fourth light emitting control driver 440 may be included. For example, when the pixels PXL1, PXL2, and PXL3 further include light emitting control transistors positioned on a current path of a driving current, the display device 100 may further include light emitting control drivers 410, 420, 430 and 440 for controlling the light emitting control transistors.

According to an embodiment, the first light emitting control driver 410 may be provided in the first non-pixel area NA1 at the periphery of the first pixel area AA1. For example, the first light emitting control driver 410 may be disposed in the first non-pixel area NA1 so as to be adjacent to the first scan driver 210.

According to an embodiment, the second light emitting control driver 420 may be provided in the second non-pixel area NA2 at the periphery of the second pixel area AA2. For example, the second light emitting control driver 420 may be disposed in the second non-pixel area NA2 so as to be adjacent to the second scan driver 220.

According to an embodiment, the third light emitting control driver 430 and the fourth light emitting control driver 440 may be provided in the third non-pixel area NA3 and the fifth non-pixel area NA5, which are opposite to each other, respectively, with the third pixel area AA3 interposed therebetween. The third light emitting control driver 430 may be disposed in the third non-pixel area NA3 so as to be adjacent to the third scan driver 230, and the fourth light emitting control driver 440 may be disposed in the fifth non-pixel area NA5 so as to be adjacent to the fourth scan driver 240.

As described above, the display device 100 may include various control circuits depending on types and/or structures of the pixels PXL1, PXL2, and PXL3. At least a portion of the control circuits may be embedded in the display panel to be directly formed on the substrate 110, or provided external to the substrate 110 to be connected to the substrate 110. For example, at least a portion of the first, second, third, and fourth scan drivers 210, 220, 230, and 240 and the first, second, third, and fourth light emitting control drivers 410, 420, 430, and 440 may be directly formed on the substrate 110 along with a pixel circuit constituting the pixels PXL1, PXL2, and PXL3, to form an internal circuit. Formation of these scan drivers 210, 220, 230, 240 may occur during the forming of the pixels PXL1, PXL2, and PXL3.

Figure 7:
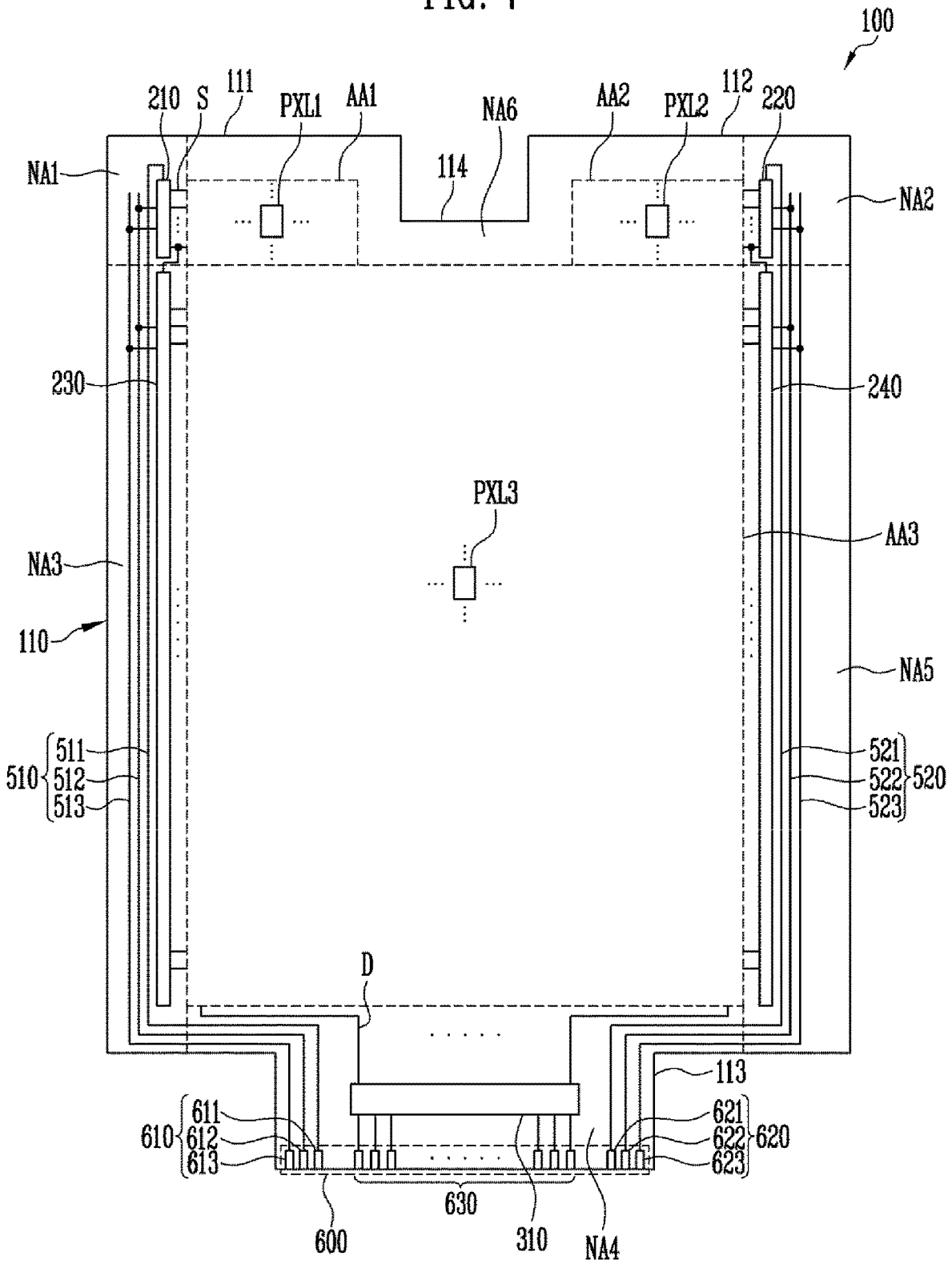
FIG. 7 illustrates an embodiment of wires, and pads connected thereto, arranged in a display device according to an embodiment of the present disclosure.
Figure 8:
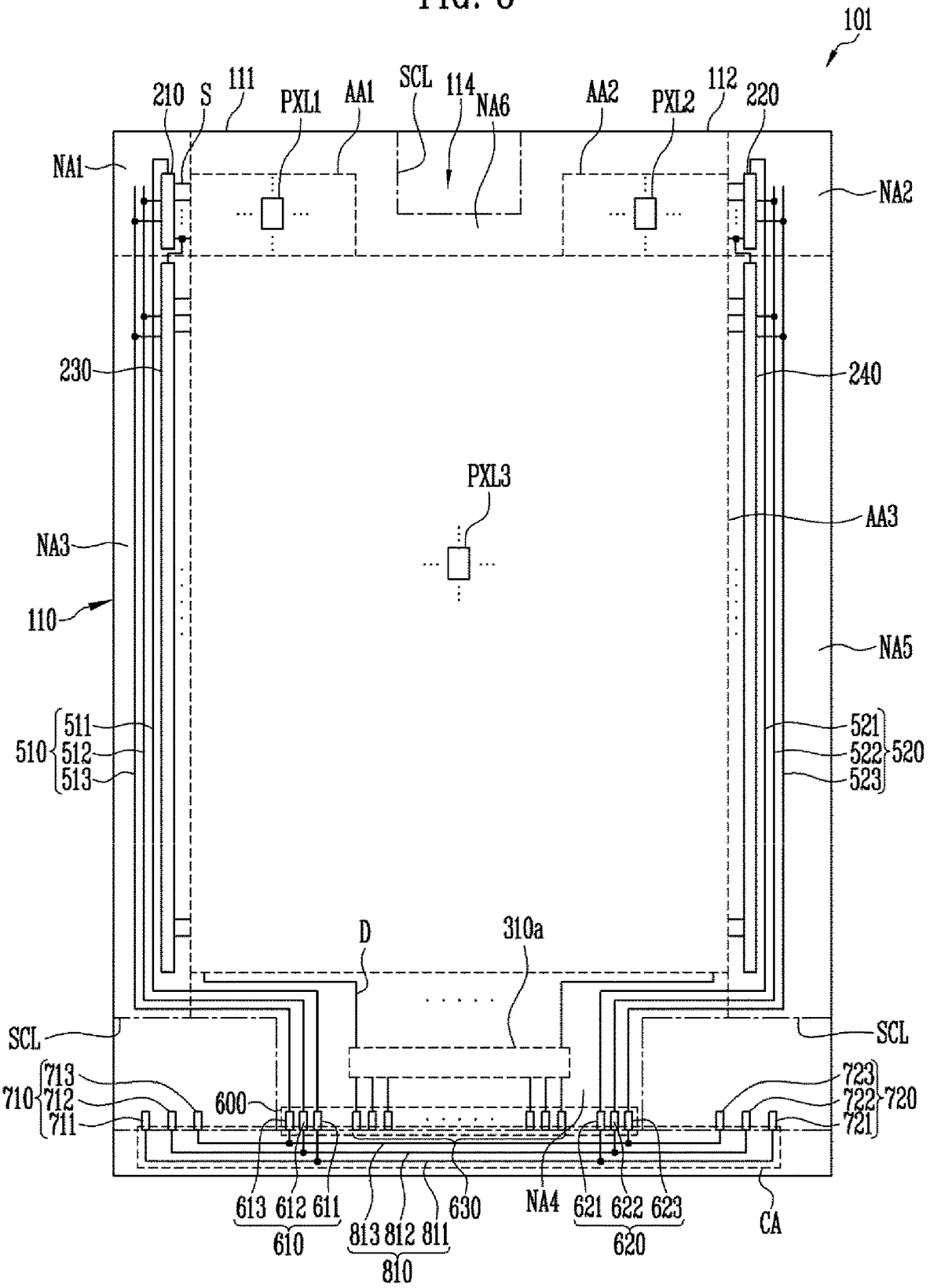
FIG. 8 illustrates an individual panel area according to an embodiment of the present disclosure, for example, an individual panel area prior to completion of a scribing process for fabricating the display device shown in FIG. 7.

FIG. 7 illustrates an embodiment of wires, and pads connected thereto, provided with a display device according to an embodiment of the present disclosure. FIG. 8 illustrates an individual panel area according to an embodiment of the present disclosure, and more particularly an individual panel area prior to completing a scribing process for fabricating the display device shown in FIG. 7. For convenience of explanation, an exemplary configuration of wires and pads will be described with reference to FIGS. 7 and 8 by applying the embodiment shown in FIG. 2A. In FIGS. 7 and 8, the same or similar configurations as those in FIG. 2A are denoted by the same reference numerals, and a detailed description thereof will be omitted.

Referring to FIG. 7, the display device 100 according to an embodiment of the present disclosure may include a plurality of first wires 510 connected to at least the first scan driver 210, and a plurality of second wires 520 connected to at least the second scan driver 220. According to an embodiment, the first wires 510 may be further connected to the third scan driver 230 and the second wires 520 may be further connected to the fourth scan driver 240. Alternatively, the first wires 510 and the second wires 520 may be connected to the first scan driver 210' and the second scan driver 220' as shown in FIG. 2B, respectively, according to an embodiment.

According to an embodiment, the first wires 510 and the second wires 520 each may supply one or more scan control signals (for example, a start pulse SSP and/or one or more clock signals CLK1 and CLK2) at least to one of the first scan driver 210 and the second scan driver 220. For example, the first wires 510 may consist of a plurality of wires supplying a plurality of scan control signals to the first and third scan drivers 210 and 230. The second wires 520 may be formed of a plurality of wires for supplying a plurality of scan control signals to the second and fourth scan drivers 220 and 240.

For example, the first wires 510 may include a first signal line 511 to which a first control signal such as the start pulse SSP is applied, and at least one of second signal lines 512 and 513 to which a second control signal such as at least one of the clock signals CLK1 and/or CLK2 is applied. According to an embodiment, as shown in FIGS. 3 and 4, when the scan stage circuits SST11 to SST1*i* and SST31 to SST3*k* constituting the first and third scan drivers 210 and 230 are driven by two clock signals such as the first and second clock signals CLK1 and CLK2, the first wires 510 may include two second signal lines 512 and 513 for transmitting the two clock signals CLK1 and CLK2, respectively.

According to an embodiment, the first wires 510 may be connected to first scan pads 610 and transmit scan control signals, for example the start pulse SSP and the first and second clock signals CLK1 and CLK2, from the first scan pads 610 to the first and third scan drivers 210 and 230. To this end, the first wires 510 may extend to the first non-pixel area NA1 via the third non-pixel area NA3 and the fourth non-pixel area NA4 in which the first scan pads 610 are provided.

In addition, according to an embodiment, at least one of the first wires 510 may be concurrently or commonly connected to the first and third scan drivers 210 and 230. For example, when the first and third scan drivers 210 and 230 are driven by the same clock signals CLK1 and CLK2, two second signal lines 612 and 613 transmitting the clock signals CLK1 and CLK2 may be concurrently or commonly connected to the scan stage circuits SST11 to SST1*i* and SST31 to SST3*k* of the first and third scan drivers 210 and 230. According to an embodiment, the first signal line 511 transmitting the start pulse SSP may be connected to the first scan stage circuit SST11 of the first scan driver 210. In an embodiment in which the third scan driver 230 is driven by a separate start pulse SSP rather than being driven by an output signal of the first scan driver 210, the first signal line 511 or another signal line which is not shown may be connected to the first scan stage circuit SST31 of the third scan driver 230.

According to an embodiment, the second wires 520 may include a plurality of signal lines 521, 522, and 523 to which the same signals as the first wires 510 are applied. For example, the second wires 520 may include a third signal line 521 to which a first control signal such as the start pulse SSP (which is also applied to the first signal line 511) is applied, and one or more fourth signal lines 522 and 523 to which a second control signal such as the clock signals CLK1 and/or CLK2 (which are also applied to at least one of the second signal lines 512 and 513) are applied. For example, the second wires 520 may include two fourth signal lines 522 and 523 for transmitting the first and second clock signals CLK1 and CLK2.

According to an embodiment, the second wires 520 may be connected to second scan pads 620 to transmit the scan control signals supplied from the second scan pads 620, for example the start pulse SSP and the first and second clock signals CLK1 and CLK2, to the second and fourth scan drivers 220 and 240. To this end, the second wires 520 may extend to the second non-pixel area NA2 via the fifth non-pixel area NA5 and the fourth non-pixel area NA4 in which the second scan pads 620 are provided.

In addition, according to an embodiment, at least one of the second wires 520 may be concurrently or commonly connected to the second and fourth scan drivers 220 and 240. For example, when the second and fourth scan drivers 220 and 240 are driven by the same two clock signals CLK1 and CLK2, two fourth signal lines 522 and 523 transmitting the clock signals CLK1 and CLK2 may be concurrently or commonly connected to the scan stage circuits SST21 to SST2*j* and SST31 to SST3*k* of the second and fourth scan drivers 220 and 240. According to an embodiment, the third signal line 521 transmitting the start pulse SSP may be connected to the first scan stage circuit SST21 of the second scan driver 220. However, in an embodiment in which the fourth scan driver 240 is driven by another start pulse SSP rather than being driven by an output signal of the second scan driver 220, the third signal line 521 or another signal line which is not shown may be connected to the first scan stage circuit SST31 of the fourth scan driver 240.

In addition, the display device 100 may further include a pad unit 600 including the first scan pads 610 connected to the first wires 510, the second scan pads 620 connected to the second wires 520, and data pads 630 connected to the data driver 310. According to an embodiment, the pad unit 600 may be provided in the fourth non-pixel area NA4, but the present invention is not limited thereto.

The display device 100 may further include at least one power line and/or signal line (not shown) in addition to the first wires 510 and the second wires 520. For example, the display device 100 may further include at least one of power supply lines for supplying the first and second pixel power sources ELVDD and ELVSS to the pixels PXL1, PXL2 and PXL3, power supply lines for supplying the first and second driving power supplies VDD and VSS to the first, second, third and fourth scan drivers 210, 220, 230, and 240, and signal lines for supplying control signals to the data driver 310. The power supply lines and/or signal lines may be disposed in at least one of the first, second, third, fourth, fifth and sixth non-pixel areas NA1, NA2, NA3, NA4, NA5, and NA6.

According to an embodiment, the pad unit 600 may include the first scan pads 610 connected to the first wires

510, the second scan pads 620 connected to the second wires 520, and the data pads 630 connected to the data driver 310. In addition, according to an embodiment, the pad unit 600 may further include at least one pad other than the first and second scan pads 610 and 620 and the data pads 630, where this additional pad or pads are connected to at least one of a power supply line and/or a signal line different from those shown.

According to an embodiment, each of pads 610, 620 and 630 included in the pad unit 600 may be connected to a film unit (not shown) such as a chip-on film (COF) or a flexible circuit board (FPC), to receive a predetermined signal or a power source from the film unit. For example, scan control signals (e.g., a start pulse SSP and clock signals CLK1 and CLK2) for driving the first and third scan drivers 210 and 230 may be applied to the first scan pads 610, and scan control signals for driving the second and fourth scan drivers 220 and 240 may be applied to the second scan pads 620. According to an embodiment, the first scan pads 610 and the second scan pads 620 may receive substantially the same signals and/or power sources. In addition, data control signals and image data for driving the data driver 310 may be applied to the data pads 630. That is, the pad unit 600 allows a panel to be electrically connected to an external driving circuit and/or a power source.

According to an embodiment, the first scan pads 610 may include a plurality of scan pads 611, 612, and 613 each connected to one of the first and second signal lines 511, 512, and 513. The second scan pads 620 may include a plurality of scan pads 621, 622, and 623 each connected to one of the third and fourth signal lines 521, 522, and 523.

According to an embodiment, at least one of the first scan pads 610 and at least one of the second scan pads 620 may receive the same signal. For example, one of the first scan pads 610 and one of the second scan pads 620 may receive the same start pulse SSP. In addition, the other one of the first scan pads 610 and the other one of the second scan pads 620 may be supplied with the same first clock signal CLK1, and another one of the first scan pads 610 and another one of the second scan pads 620 may receive the same second clock signal CLK2.

According to an embodiment, the data pads 630 may be connected to the data driver 310 and transmit the data control signals and the image data for driving the data driver 310. According to an embodiment, the data driver 310 may be mounted outside the substrate 110. In this case, the data pads 630 may electrically connect a data driver, which may be external to the substrate 100 and which is not shown, to the data lines D.

In FIG. 7, a reference character S (not described) broadly denotes the first to third scan lines S11 to S1*i*, S21 to S2*j*, and S31 to S3*k* described in FIG. 3. Similarly, reference numeral D broadly refers to the data lines D1 to Do described in FIG. 3.

As described above, the display device 100 according to an embodiment of the present disclosure may include the first and second scan drivers 210 and 220 provided on both sides of the substrate 110, and the first and second wires 510 and 520 provided on both sides of the substrate 110 to supply scan control signals to the first and second scan drivers 210 and 220. Thus, the first and second pixel areas AA1 and AA2, which are spaced apart from each other so that at least the scan lines S are separated from each other, may be effectively driven.

In addition, in the display device 100 according to an embodiment of the present disclosure, the third and fourth scan drivers 230 and 240 may be provided on both sides of the third pixel area AA3 which is a relatively large area, thereby supplying the third scan signal to both ends of the third scan lines S31 to S3*k*. As a result, driving failure due to delay in the third scan signal may be prevented. However, the present disclosure is not limited thereto. For example, in another embodiment, only one of the third and fourth scan drivers 230 and 240 may be provided.

The display device 100 as described above may be subjected to a lighting test and/or an aging step before being shipped, and only a product determined to be qualified by this process may be shipped. According to an embodiment, the lighting test and/or the aging step may be performed on a lump-sum basis for a plurality of panels that are not separated on the motherboard, or may be performed on an individual panel basis.

For example, the lighting test and/or the aging step may be performed on an individual panel basis, before the scribing process for each panel formed in the individual panel area 101 is completed. More specifically, while fabricating a panel, test pads may be formed outside the final scribing line for the individual panel, and before the final scribing process is performed, the lighting test and/or the aging step on an individual panel may be performed by supplying a lighting test signal or an aging signal together with test control signals, through the test pads.

According to an embodiment, test pads 710 and 720 may be provided outside the scribing line SCL (for example, outside the final scribing line SCL) of each panel area 101 as shown in FIG. 8. According to an embodiment, the test pads 710 and 720 may include first test pads 710 connected to the first wires 510, and second test pads 720 connected to the second wires 520.

Specifically, in the embodiment of the present disclosure, the first and second pixel areas AA1 and AA2 may be spaced apart from each other, and the first and second scan lines S11 to S2*i* and S21 to S2*j* may be separated from each other. Therefore, in the embodiment of the present disclosure, the first wires 510 and the second wires 520, and the first scan driver 210 and the second scan driver 220, may be provided on both sides of the substrate 110 to drive the first and second pixel area AA1 and AA2, respectively. Also, the same control signals may be transmitted to the first and second scan drivers 210 and 220 through the first and second lines 510 and 520, respectively. Therefore, in the case of the test pads 710 and 720, the first test pads 710 connected to the first wires 510 and the second test pads 720 connected to the second wires 520 may be respectively provided. For example, the first test pads 710 may be formed at a lower left side portion outside the scribing line SCL on the individual panel area 101 before the scribing process is completed, and the second test pads 720 may be formed on a lower right side portion outside the scribing line SCL. The outside of the scribing line SCL may indicate an area separated from the display device 100 after completing the final scribing process.

According to an embodiment, the first test pads 710 may include a first signal pad 711 connected to the first signal line 511, and second signal pads 712 and 713 connected to the second signal lines 512 and 513. During an inspecting operation for each panel, a test control signal may be applied to the first test pads 710. According to an embodiment, scan control signals for generating the scan signals by driving the first, second, third and fourth scan drivers 210, 220, 230, and 240 may be included in the test control signals. For example, the test control signal may include the start pulse SSP and clock signals CLK1 and CLK2.

According to an embodiment, the second test pads 720 may include a third signal pad 721 connected to the third signal line 521 and the fourth signal pads 722 and 723 connected to the fourth signal lines 522 and 523 respectively. During the test operation for each panel, the test control signal may be applied to the second test pads 720. For example, during the test operation for an individual panel, a test control signal such as the start pulse SSP and clock signals CLK1 and CLK2 may be concurrently supplied to the first and second test pads 710 and 720 to drive the first, second, third, and fourth scan drivers 210, 220, 230, and 240.

According to an embodiment, the data driver 310 may be mounted only on those panels which have been determined to be good by the test step. That is, according to an embodiment, the panel in the test step may not include the data driver 310, and a data driver mounting area 310*a* on which the data driver 310 is to be mounted may be defined on the substrate 110. Therefore, in order to supply a test signal (e.g., a lighting test signal) and/or an aging signal to the data lines D in the test step and/or the aging step, data test pads (which are not shown) may be further provided in a dummy area outside the scribing line SCL. The data test pads may be electrically connected to the data lines D to supply the lighting test signal or the aging signal to the data lines D. In addition, in the test step, to apply predetermined power sources (e.g., first and second driving power supplies VDD and VSS, the first and second pixel power sources ELVDD and ELVSS and/or the initial power supply Vinit) to the panel, the test pads for applying the power source may be additionally provided in the dummy area outside the scribing line SCL.

The first, second, third, and fourth scan drivers 210, 220, 230, and 240, which are supplied with the test control signals in the test step and/or the aging step for each panel, may generate the scan signal and sequentially supply the generated scan signal to the scan lines S. Accordingly, the test signal (e.g., a lighting test signal) and/or the aging signal supplied from the data test pads to the data lines D may be supplied to the pixels PXL1, PXL2, and PXL3.

For example, the pixels PXL1, PXL2, and PXL3 may receive the lighting test signal and emit light of a predetermined brightness in response to the lighting test signal. Defects on the pixels PXL1, PXL2, PXL3 may be detected by checking whether light is properly emitted from the pixels PXL1, PXL2, PXL3. The aging process is performed in the pixels PXL1, PXL2, and PXL3 supplied with the aging signal. Thus, the image quality of the display device 100 may be stabilized.

As described above, in the testing of the display device 100, the first, second, third, and fourth scan drivers 210, 220, 230, and 240 may be driven by supplying the test control signal to each of the first and second test pads 710 and 720 formed in one area of the substrate 110 (for example, a dummy area outside the final scribing line SCL), respectively. However, in the process of supplying the test control signals to each of the first and second test pads 710 and 720, at least one test pad of the test pads 710 and 720 may not be properly contacted to a signal output unit of the test equipment for supplying the test control signal. As a result, defects may occur in the display device 100.

For example, when the test control signal is not properly input to at least one test pad included in the first test pads 710, the first and third scan drivers 210 and 230, which are supplied with the test control signal from the test pad, may not properly output the scan signal. The third pixel area AA3 may receive the scan signal from the fourth scan driver 240. However, in the case of the first pixel area AA1 separated from the second pixel area AA2, the scan signal may not be properly supplied to the first pixel area AA1. Accordingly, the first pixels PXL1 may not be properly supplied with the test signal (which includes the lighting test signal or the aging signal). Therefore, the lighting test, the aging process and/or the like may not be smoothly performed in the first pixels PXL1, thereby allowing defects in the display device 100 to pass undetected.

In order to reduce these defects, in the embodiment of the present disclosure, a plurality of connecting wires 810 may be provided to connect the first wires 510 and the second wires 520 (or first test pads 710 and second test pads 520). The first wires 510 may extend to the first and third scan drivers 210 and 230 via the pad unit 600 from the first test pads 710, thereby broadly indicating wires transmitting the scan control signals (or test control signals) to the first and third scan drivers 210 and 230. In addition, the second wires 520 may extend to the second and fourth scan drivers 220 and 240 from the second test pads 720 via the pad unit 600, thereby broadly indicating wires transmitting the scan control signals (or test control signals) to the second and fourth scan drivers 220 and 240.

According to an embodiment, the connecting wires 810 may be connected between signal lines transmitting the same signal to each other. For example, the connecting wires 810 may include a first connecting wire 811 connecting the first signal line 511 and the third signal line 521, and second connecting wires 812 and 813 connecting signal lines for transmitting the same clock signal CLK1 or CLK2 of the second signal lines 512 and 513 and the fourth signal lines 522 and 523.

According to the embodiment of the present disclosure described above, although the test control signal is not properly supplied to at least one test pad connected to at least one wire arranged on one side of the substrate 110 (for example, at least one wire included in the first wires 510 or the second wires 520), the first and second wires 510 and 520 may properly transmit the test control signal to the first, second, third and fourth drivers 210, 220, 230, and 240. Accordingly, the driving signals may be properly supplied to each of the pixel areas AA1, AA2, and AA3 in the test step and/or the aging step, thereby preventing defects of the display device 100. That is, according to the embodiment of the present disclosure, in the display device 100 including the first and second pixel areas AA1 and AA2 spaced apart from each other, the pixel areas AA1, AA2, and AA3 of the display device 100 may be effectively driven by using the first and second wires 510 and 520 transmitting the same signal, and defects of the display device 100 may thus be prevented or reduced.

FIGS. 9A to 9D sequentially illustrate a method of fabricating a display device according to an embodiment of the present disclosure, for example, a method of fabricating the display device shown in FIGS. 7 and 8. Hereinafter, a method of fabricating a display device according to an embodiment of the present disclosure will be described with reference to FIGS. 9A to 9D with FIGS. 7 and 8. In FIGS. 9A to 9D, the same or similar constituent elements to those in FIGS. 7 and 8 are denoted by the same reference numerals, and a detailed description thereof will be omitted.

Figure 9A:
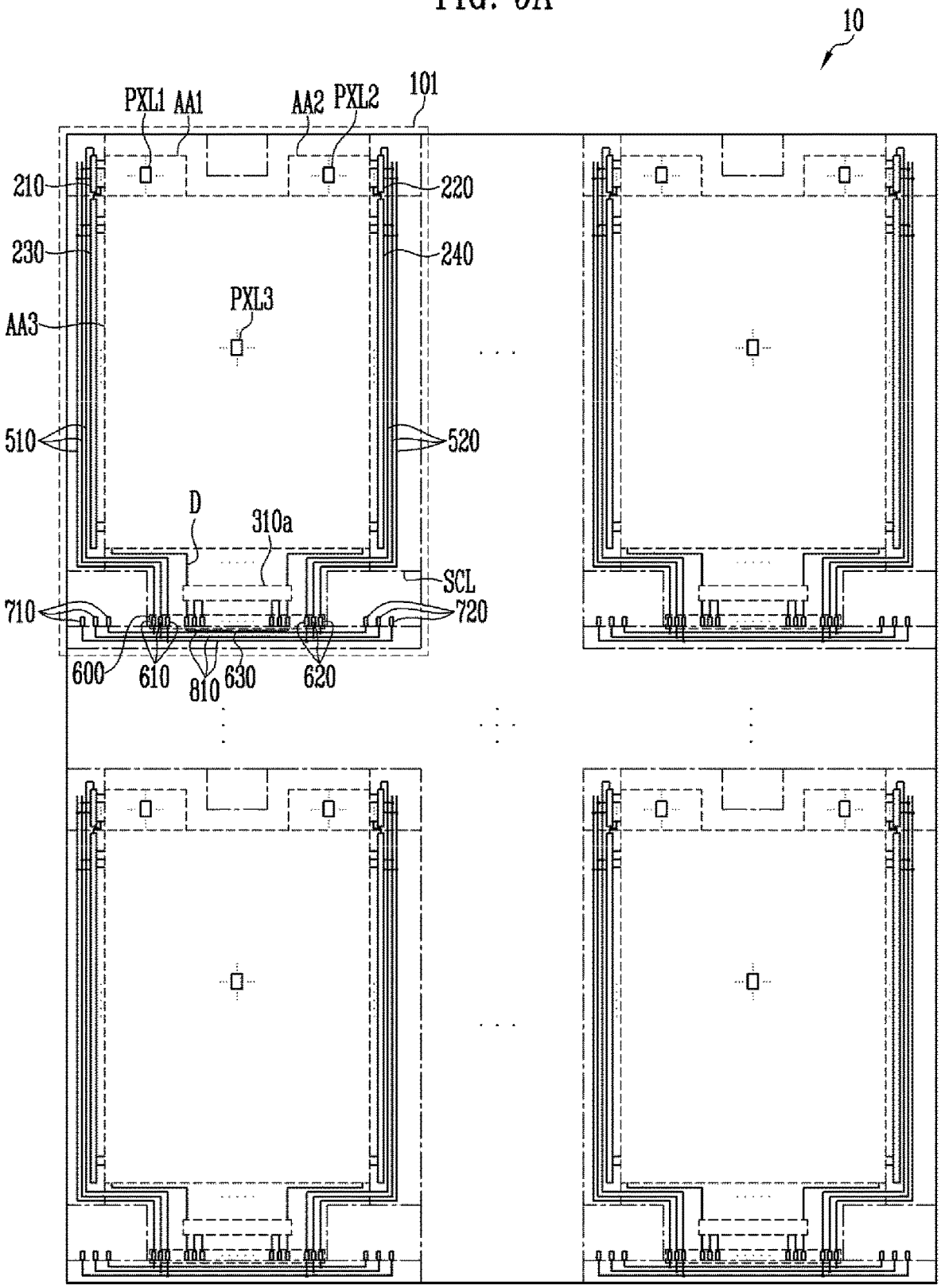
FIGS. 9A, 9B, 9C, and 9D sequentially illustrate a method of fabricating a display device according to an embodiment of the present disclosure, for example, a method of fabricating the display device shown in FIGS. 7 and 8.

Referring to FIG. 9A, in each panel area 101 defined on a mother substrate 10, the display device 100 as shown in FIGS. 7 and 8 may be formed.

For example, inside the scribing line SCL defined in an individual panel area 101 of the mother substrate 10, the first and second pixels PXL1 and PXL2 of the first and second pixel areas AA1 and AA2, and the first and second wires 510 and 520 transmitting the driving signals (for example, scan control signals) for driving the first and second pixels PXL1 and PXL2, respectively, may be formed.

In addition, the first scan driver 210 connected between the first pixel area AA1 and the first wires 510, and the second scan driver 220 connected between the second pixel area AA2 and the second wires 520, may be further formed in an area inside the scribing line SCL. Further, according to an embodiment, the third pixels PXL3 of the third pixel area AA3 disposed on one side of the first and second pixel areas AA1 and AA2, and the third and/or fourth scan drivers 230 and 240 connected between the third pixel area AA3 and the first and/or second wires 510 and 520, may be further formed in an area inside the scribing line SCL.

According to an embodiment, the first wires 510 may be formed on one side (for example, a left side) of the first pixel area AA1 and one side (for example, a left side) of the third pixel area AA3. The second wires 520 may be formed on one side (e.g., a right side) of the second pixel area AA2 and on another side (e.g., a right side) of the third pixel area AA3 to be opposite to the first wires 510.

The first and second test pads 710 and 720, connected to the first and second wires 510 and 520 respectively, may be formed in an area outside the scribing line SCL in the individual panel area 101. An external portion of, or the area outside of, the scribing line SCL may broadly refer to an area separated from a final product through one or more cutting or scribing processes using one or more scribing lines SCL. For example, the external portion of the scribing line SCL may broadly refer to an area removed through one or more scribing processes and/or grinding processes, respectively, thereby indicating the external portion of the scribing line SCL used in the final scribing process.

According to an embodiment, a plurality of connecting wires 810 connecting test pads 710, 720 to which the same signal is applied may be formed outside the scribing line SCL. However, the positions of the connecting wires 810 in the present disclosure are not limited to the outside of the scribing line SCL. For example, the connecting wires 810 may be formed inside the scribing line SCL according to another embodiment.

According to an embodiment, in the forming of the connecting wires 810, the first connecting wire 811 connecting the first and third signal pads 711 and 721, which are supplied with the first test control signal (e.g., a start pulse SSP) and the second connecting wires 812 and 813 connecting the second and fourth signal pads 712, 713, 722 and 723, which are supplied with the second test control signal (e.g., first and second clock signals CLK1 and CLK2), may be formed.

According to an embodiment, at least a portion of the interconnecting wires 810 may include at least one conductive layer (or, s sub wire) located on a different layer from a conductive layer constituting the first and second interconnecting wires 510 and 520. In addition, according to an embodiment, the connecting wirings 810 may be formed to have substantially the same structure or different structures. Embodiments related to the above will be described below.

Figure 9B:
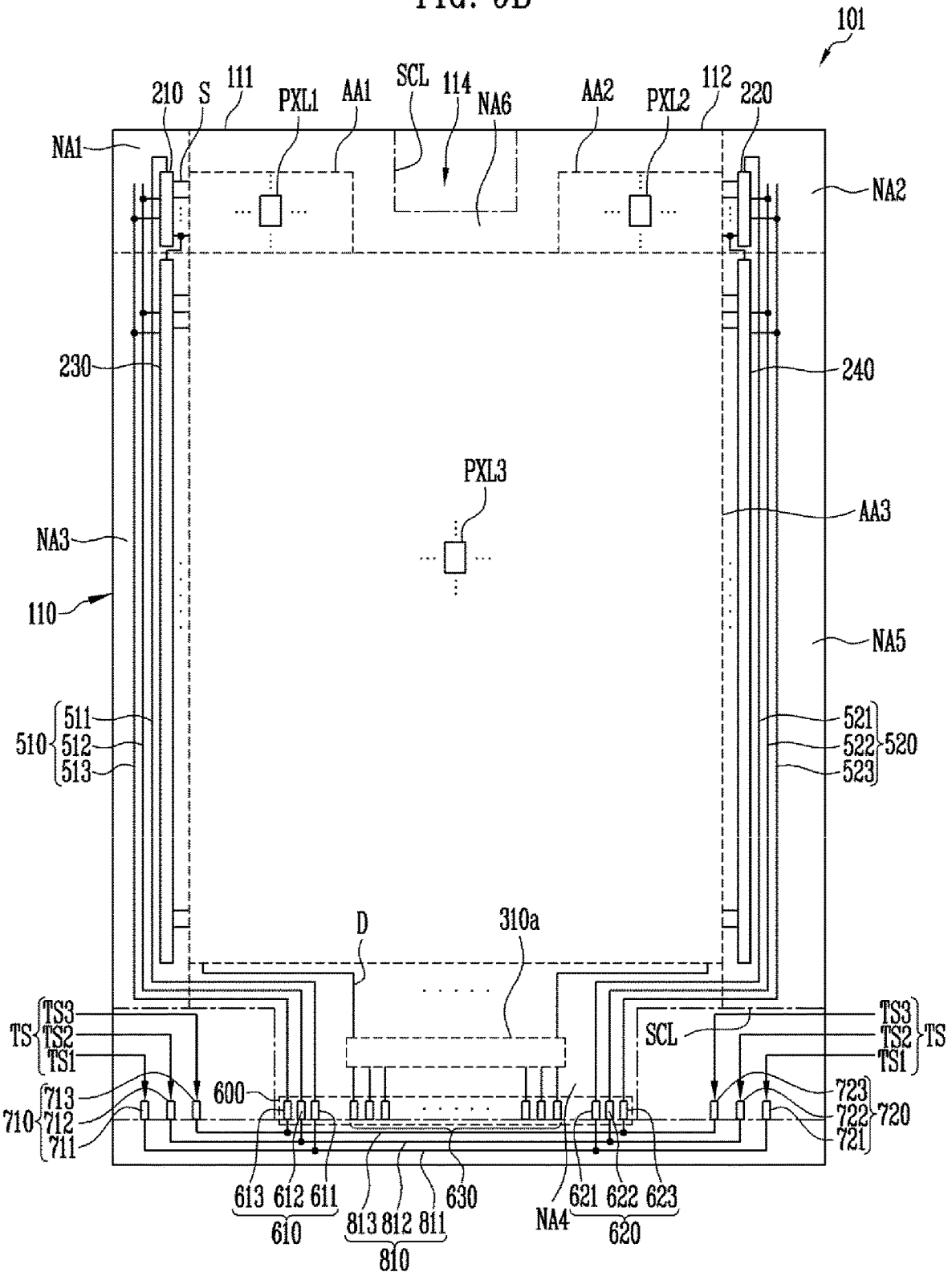

Referring to FIG. 9B, a predetermined test (for example, the lighting test and/or the aging) on the display device 100 provided in the individual panel area 101 may be performed by supplying predetermined test control signals TS to the first and second test pads 710 and 720. For example, test control signals TS (scan control signals) for driving at least the first, second, third and fourth scan drivers 210, 220, 230 and 240 may be concurrently supplied to the first and second test pads 710 and 720. More specifically, the first test control signal TS1 corresponding to the start pulse SSP may be supplied to the first and third signal pads 711 and 721, the second test control signal TS2 corresponding to the first clock signal CLK1 may be applied to one of the second signal pads 712, 713 and one of the fourth signal pads 722, 723, and the third test control signal TS3 corresponding to the second clock signal CLK2 may be applied to the other one of the second signal pads 712, 713 and the other one of the fourth signal pads 722, 723. That is, according to an embodiment, the same test control signal TS may be supplied to at least one of the first test pads 710 and at least one of the second test pads 720.

Figure 9C:
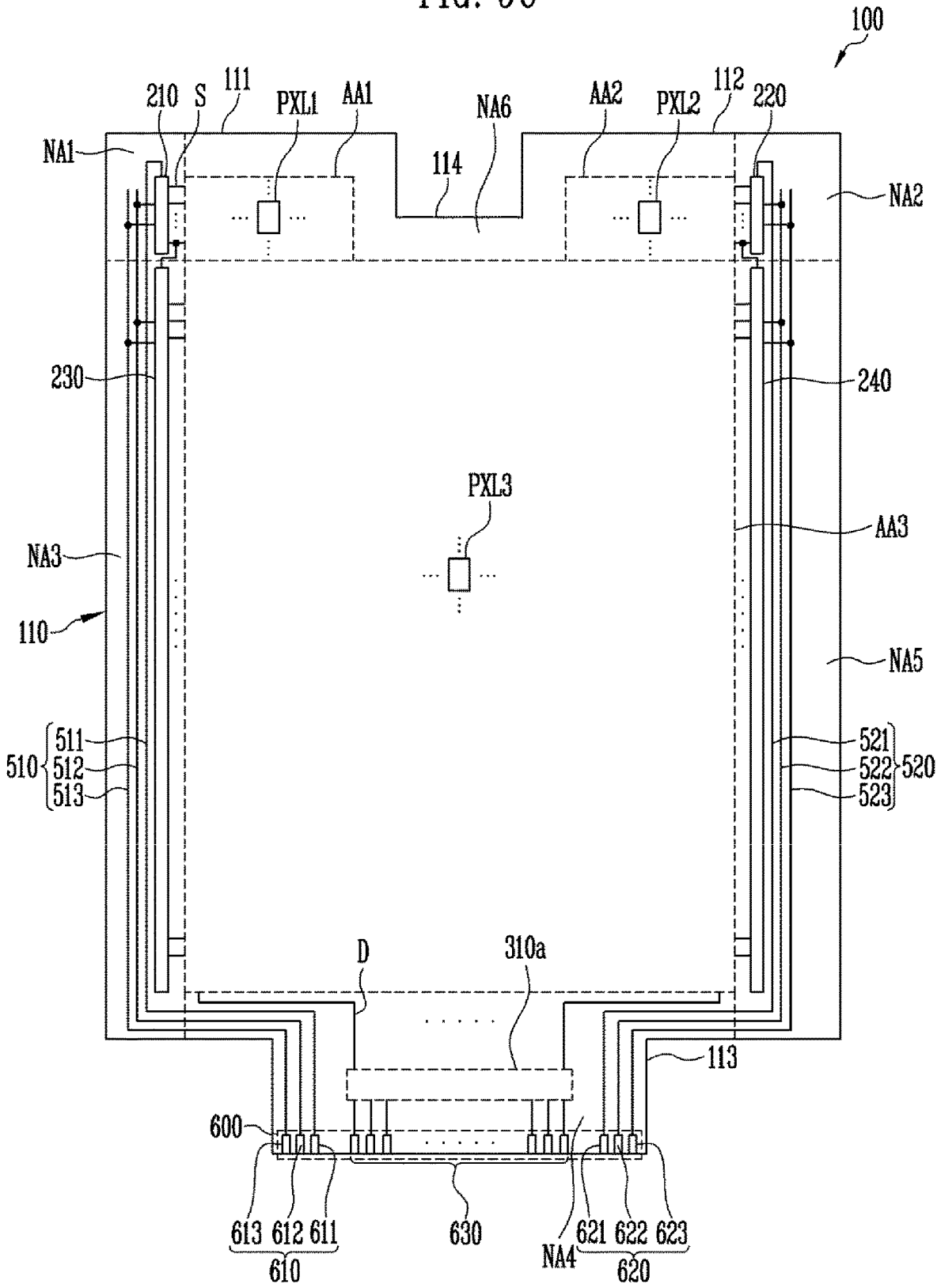

Referring to FIG. 9C, by performing a scribing process (a cutting process) along the scribing line SCL, the first and second test pads 710 and 720 may be separated from the display device 100. According to an embodiment, when the interconnecting lines 810 are disposed outside the scribing line SCL, while performing the scribing process, the connecting wires 810 may be separated from the display device 100 and the first and second test pads 710 and 720.

Figure 9D:
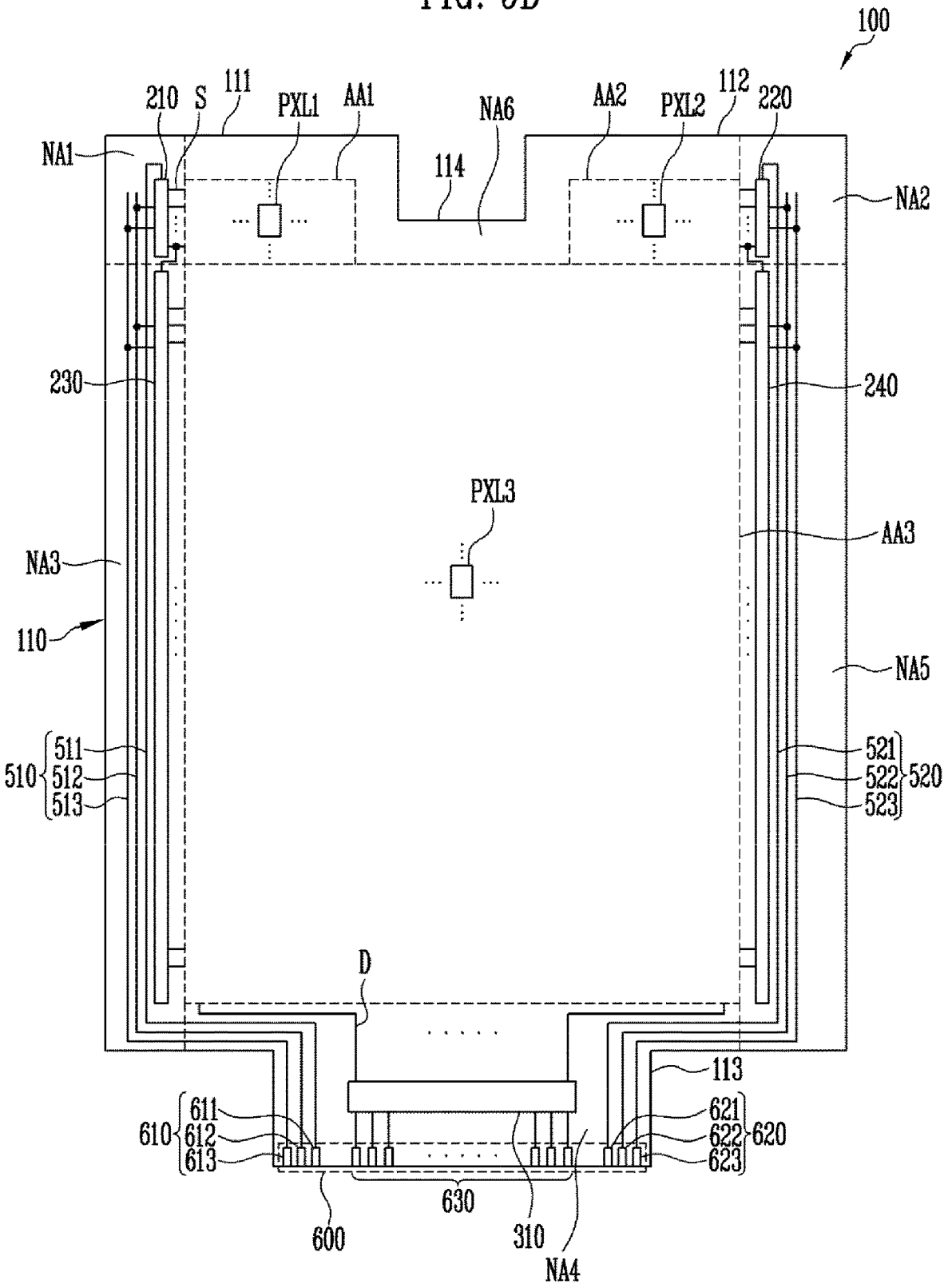

Referring to FIG. 9D, the data driver 310 may be mounted on the data driver mounting area 310*a* of the display device 100 once it is determined to be good. However, the present disclosure is not limited thereto, and according to an embodiment, the data driver 310 may be mounted outside the substrate 110. For example, the data driver 310 may be mounted on a film unit (not shown) of a chip-on film (COF) or a flexible circuit board (FPC), and the film unit may be connected to the pad unit 600, so that the data signal from the data driver 310 may be transmitted to the data lines D.

Figure 10:
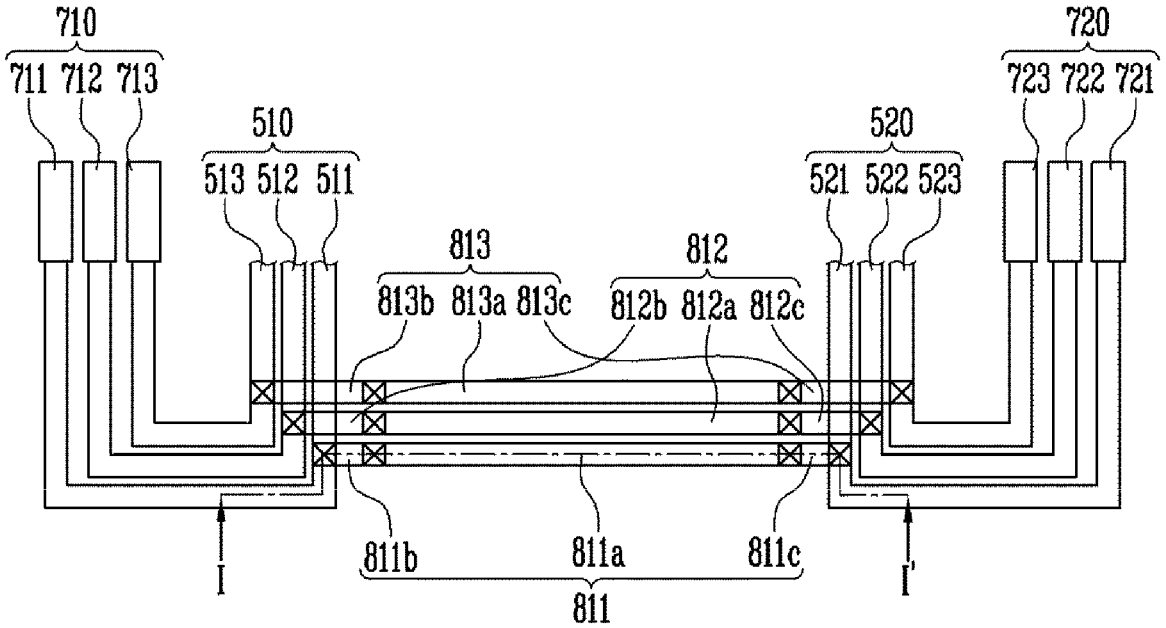
FIG. 10 illustrates an embodiment of test pads shown in FIG. 8 and a connecting area (CA) under the test pads shown in FIG. 8.
Figure 11A:
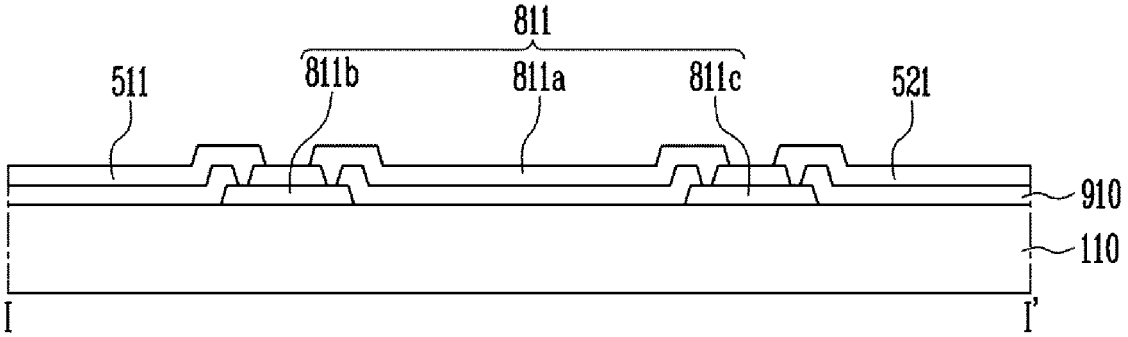
FIG. 11A illustrates an example of a cross section taken along line I-I' of FIG. 10.
Figure 11B:
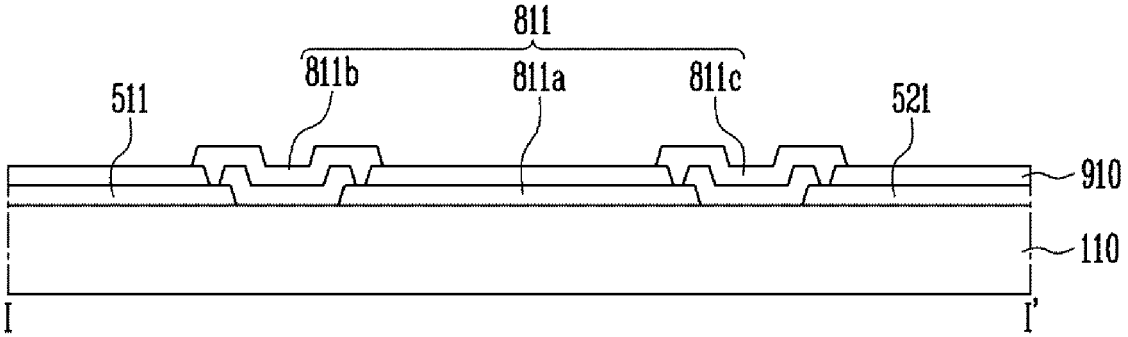
FIG. 11B illustrates another example of a cross section taken along line I-I' of FIG. 10.

FIG. 10 illustrates an embodiment of test pads shown in FIG. 8 and a connecting area (CA) under the test pads shown in FIG. 8. FIG. 11A illustrates an example of a cross section taken along line I-I' of FIG. 10. FIG. 11B illustrates another example of a cross section taken along line I-I' of FIG. 10. In FIGS. 10 to 11B, the same or similar constituent elements to those in FIGS. 7 and 8 are denoted by the same reference numerals, and a detailed description thereof will be omitted.

Referring to FIGS. 10 to 11B, the connecting wires 811, 812, and 813 may include at least one conductive layer arranged on a different layer from the conductive layer constituting the first and second wires 510 and 520. According to an embodiment, the conductive layer may include at least one of a metal, an alloy thereof, a conductive polymer, and a conductive metal oxide. For example, metals that constitute the conductive layer may include at least one of Ti, Cu, Mo, Al, Au, Ag, Pt, Pd, Ni, Sn, Co, Rh, Jr, Fe, Ru, Os, Mn, W, Nb, Ta, Bi, Sb, Pb, etc. In addition, various metals and/or their alloys may be used. Examples of alloys that constitute the conductive layer may be MoTi, AlNiLa, etc., and various alloys other than the above may be used. Examples of a multilayer metal that constitutes the conductive layer may be Ti/Cu, Ti/Au, Mo/Al/Mo, ITO/Ag/ITO and the like. In addition, any conductive materials, metal or otherwise, may be used in the various multilayer structures. Examples of a conductive polymer that forms the conductive layer include polythiophene-based, polypyrrole-based, polyaniline-based, polyacetylene-based, polyphenylene-based compounds and mixtures thereof. Among the polythiophene compounds, PEDOT/PSS compounds may be used. Examples of a conductive metal oxide that forms the conductive layer include at least one of ITO, IZO, AZO, ITZO, ZnO, $SnO_2$, etc. In addition to the above-described conductive material, a material that provides conductivity may be used as a constituent material of the conductive layer constituting the connecting wires 811, 812, and 813. Further, the structure of each of the connecting wires 811, 812 and 813 is not particularly limited, and the connecting wires 811, 812 and 813 may be variously formed of a single layer or a multilayer.

According to an embodiment, the first and second wires 510 and 520 may have substantially the same structure. Further, according to an embodiment, the connecting wires 811, 812, and 813 may have substantially the same structure. Therefore, embodiments related to the structure of the connecting wirings 811, 812 and 813 will be described on the basis of the first connecting wire 811 electrically connecting the first and third signal lines 511 and 521.

According to an embodiment, the first connecting wire 811 may include a first sub wire 811*a* consisting of the same material on the same layer as the first and third signal lines 511 and 521, a second sub wire 811*b* connected between the first sub wire 811*a* and the first signal line 511 and arranged on a different layer from the first sub wire 811*a*, and a third sub wire 811*c* connected between the first sub wire 811*a* and the third signal line 521 and arranged on a different layer from the first sub wire 811*a*. According to an embodiment, the second and third sub wires 811*b* and 811*c* may consist of the same material on the same layer.

For example, the second and third sub wires 811*b* and 811*c* may be formed of the same conductive material on a first layer on the substrate 110 as shown in FIG. 11A, and the first and third signal lines 511 and 521 and the first sub wire 811*a* may consist of the same conductive material on a second layer which is on a first insulating layer 910 and over the first layer. According to an embodiment, the first layer may be a gate layer and the second layer may be a source-drain layer, but the present invention is not limited thereto. For example, according to another embodiment, the first layer may be a source-drain layer and the second layer may be a gate layer. Alternatively, according to another embodiment, at least one of the first layer and the second layer may be a third conductive layer different from the gate layer and the source-drain layer.

In addition, according to an embodiment, the positions of the first sub wires 811*a* and the second and third sub wires 811*b* and 811*c* may be changed. For example, as shown in FIG. 11B, the first sub wires 811*a* and the first and third signal lines 511 and 521 may be on the first layer on the substrate 110, and the second and third sub wires 811*b* and 811*c* may be on the second layer on the first insulating layer 910.

According to an embodiment, each of the second connecting wires 812 and 813 may have substantially the same structure as the first connecting wire 811, and may be disposed to be spaced apart from the first connecting wire 811. For example, each of the second connecting wires 812 and 813 may include first sub wires 812*a* and 813*a* formed of the same material on the same layer as the second and fourth signal lines 512, 513, 522, and 523, second sub wires 812*b* and 813*b* connected between the first sub wires 812*a* and 813*a* and one of the second signal lines 512 and 513 and disposed in a different layer from the first sub wires 812*a* and 813*a*, and third sub wires 812*c* and 813*c* connected between the first sub wires 812*a* and 813*a* and one of the fourth signal lines 522 and 523 and disposed on a different layer from the first sub wires 812*a* and 813*a*. According to an embodiment, the second and third sub wires 812*b*, 812*c*, 813*b*, and 813*c* may be formed of the same material and on the same layer.

According to an embodiment, the first and second test pads 710 and 720 may include at least one conductive layer formed of the same material on the same layer as one or more conductive layers constituting the first and second wires 510 and 520 and the connecting wire 810, but the present disclosure is not limited thereto. That is, the structure and/or material of the first and second test pads 710 and 720 are not particularly limited.

Figure 12:
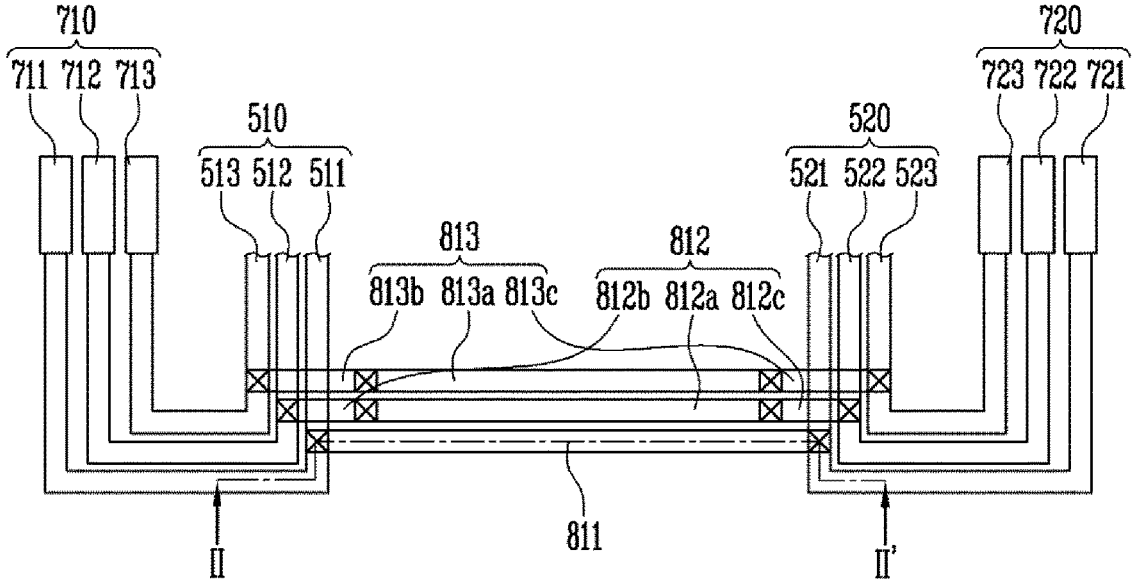
FIG. 12 illustrates another embodiment of test pads shown in FIG. 8 and a connecting area (CA) under the test pads shown in FIG. 8.
Figure 13A:
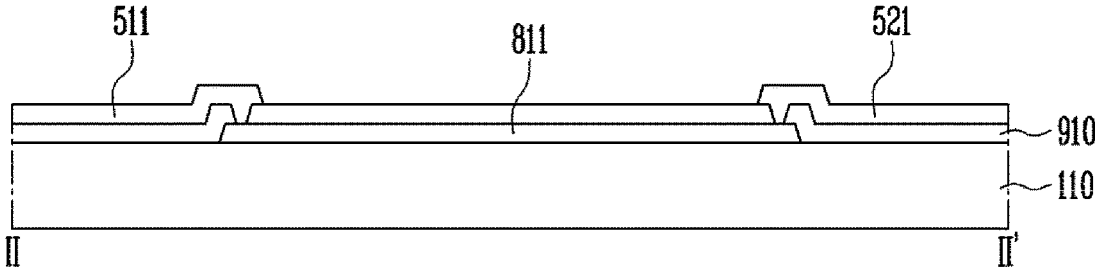
FIG. 13A illustrates an example of a cross section taken along line II-II' of FIG. 12.
Figure 13B:
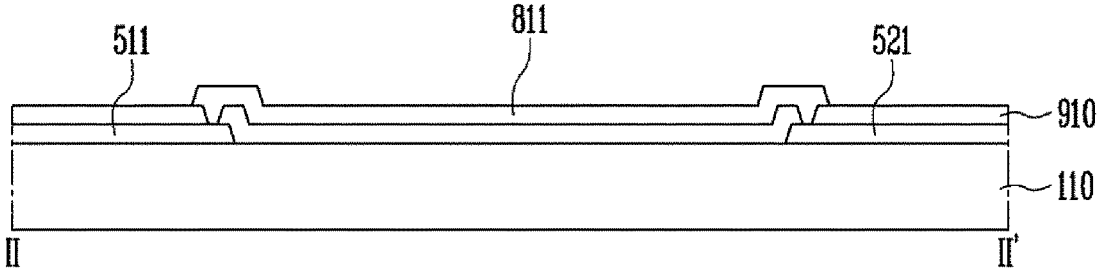
FIG. 13B illustrates another example of a cross section taken along line II-II' of FIG. 12.

FIG. 12 illustrates another embodiment of test pads shown in FIG. 8 and a connecting area (CA) under the test pads shown in FIG. 8. FIG. 13A illustrates an example of a cross section taken along line II-II' of FIG. 12. FIG. 13B illustrates another example of a cross section taken along line II-II' of FIG. 12. In FIGS. 12 to 13B, the same or similar constituent elements to those in FIGS. 10 to 11B are denoted by the same reference numerals, and a detailed description thereof will be omitted.

Referring to FIGS. 12 to 13B, at least two of the connecting wires 810 may have different structures from each other. For example, the first connecting wire 811 connecting outermost first and second test pads 710 and 720 (e.g., first and third signal pads 711 and 721) may have a different structure from the remaining connecting wires 812 and 813. For example, the plurality of second connecting wires 812 and 813 may have the same structures as in the embodiment described with reference to FIGS. 10 to 11B, and the first connecting wire 811 may have a different structure from the second connecting wires 812 and 813.

According to an embodiment, the first connecting wire 811 may be formed of the same material on the same layer as the second and third sub wires 812*b*, 812*c*, 813*b*, and 813*c* constituting the second connecting wires 812 and 813, and may consist of a single first connecting wire 811 arranged to be spaced apart from the second and third sub wires 812*b*, 812*c*, 813*b*, and 813*c*. Alternatively, in another embodiment, the first connecting wire 811 may consist of a single first connecting wire 811 formed of the same material on the same layer as the first sub wires 812*a* and 813*a*. For example, the first connecting wire 811 may be formed of the same material on the same layer as the first sub wires 812*a* and 813*a* constituting the second connecting wires 812 and 813.

According to an embodiment, the first connecting wire 811 may be disposed on the first layer on the substrate 110 as shown in FIG. 13A, and the first and the third signal lines 511 and 521 connected to each other through the first connecting wire 811 may be disposed on the first insulating layer 910 above the first connecting wire 811 to be connected to different ends of the first connecting wire 811 through the contact connection, for example, through a contact hole.

According to an embodiment, an arrangement structure between the first connecting wire 811 and the first and third signal lines 511 and 521 may be changed. For example, as shown in FIG. 13B, the first and third signal lines 511 and 521 may be arranged on the first layer on the substrate 110, and the first connecting wire 811 may be provided on the first insulating layer 910 to be connected to ends of the first and third signal lines 511 and 521 through contact connections.

According to an embodiment, the first layer and the second layer may be a gate layer or a source-drain layer, but the present disclosure is not limited thereto. For, example, at least one of the first and second layers may be another conductive layer.

In the above-described embodiment, the connecting wires 810 may be disposed outside the scribing line SCL, but the present disclosure is not limited thereto. For example, the connecting wires 810 may be disposed inside the final scribing line SCL to remain on the display device 100 after it has been fabricated. Further, the positions of the connecting wires 810 may be variously changed.

Figure 14A:
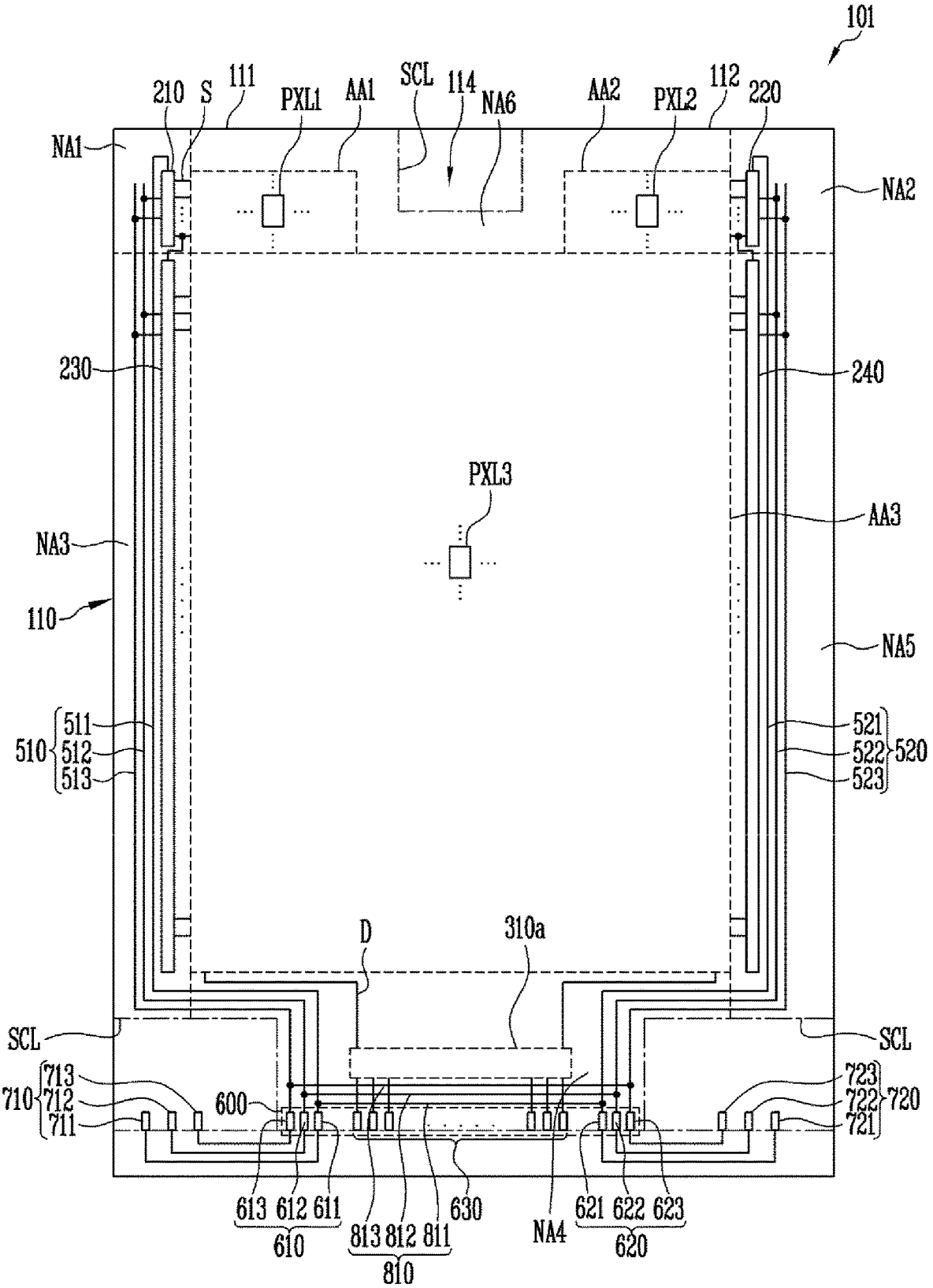
FIG. 14A illustrates an individual panel area according to another embodiment of the present disclosure.
Figure 14B:
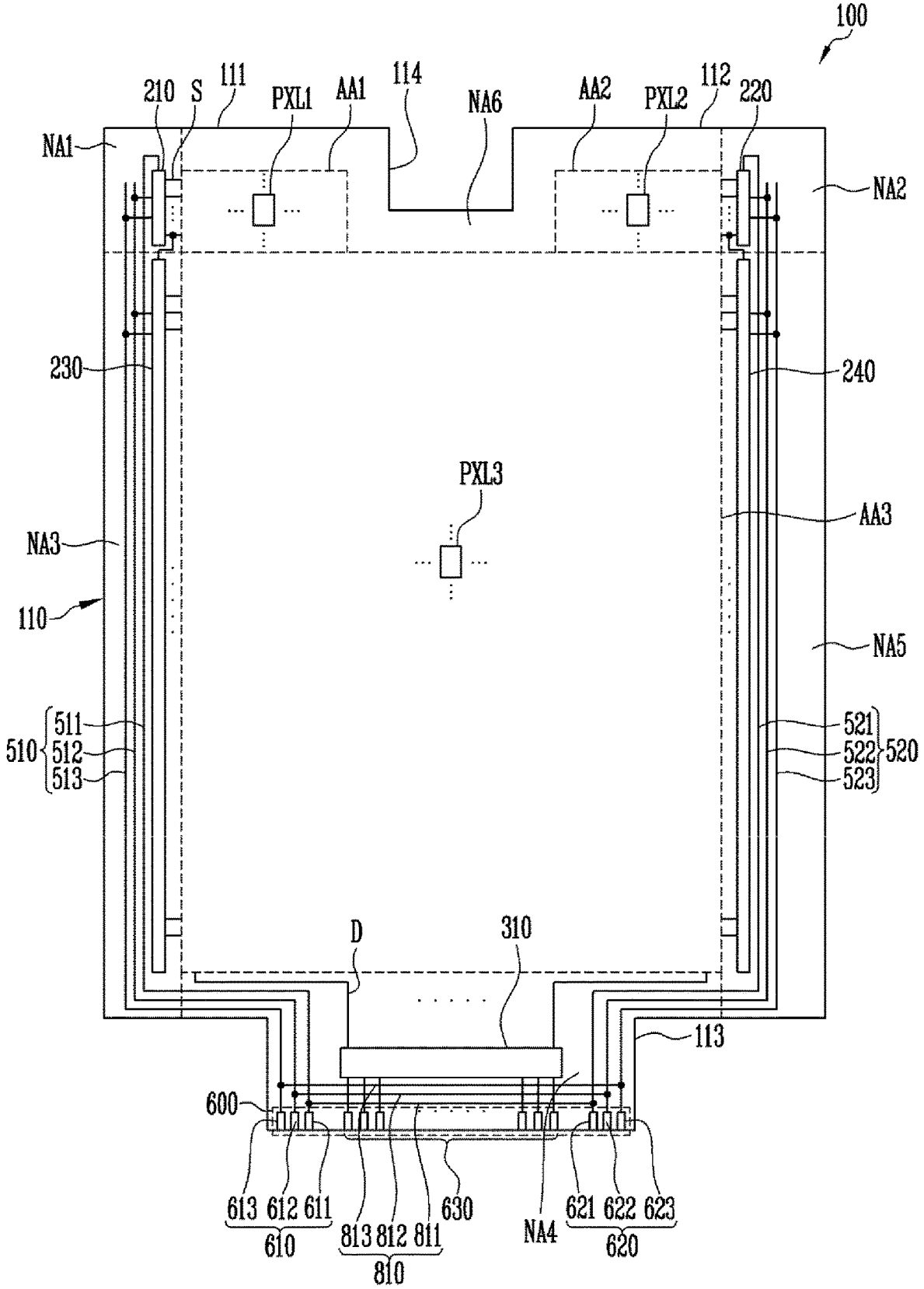
FIG. 14B illustrates a display device according to another embodiment of the present disclosure, for example, a display device fabricated by performing a scribing process on the individual panel shown in FIG. 14A.

FIG. 14A illustrates an individual panel area according to another embodiment of the present disclosure. FIG. 14B illustrates a display device according to another embodiment of the present disclosure, for example, a display device fabricated by performing a scribing process on the individual panel shown in FIG. 14A. In FIGS. 14A and 14B, the same constituent elements as those of the above-described embodiments are denoted by the same reference numerals, and a detailed description thereof will be omitted.

Referring to FIGS. 14A and 14B, the connecting wires 810 may be arranged in the fourth non-pixel area NA4 in which the pad unit 600 is located. For example, the connecting wires 810 may be disposed between the pad unit 600 and the data driver mounting area 310*a*. In this case, the connecting wires 810 may be arranged in a different layer from the wires connecting the data pads 630 and the data driver 310, to be insulated from these wires.

In other words, according to an embodiment, the connecting wires 810 may be arranged inside the scribing line SCL. In such a case, the connecting wires 810 may remain on the display device 100 after it has been fabricated.

Figure 15A:
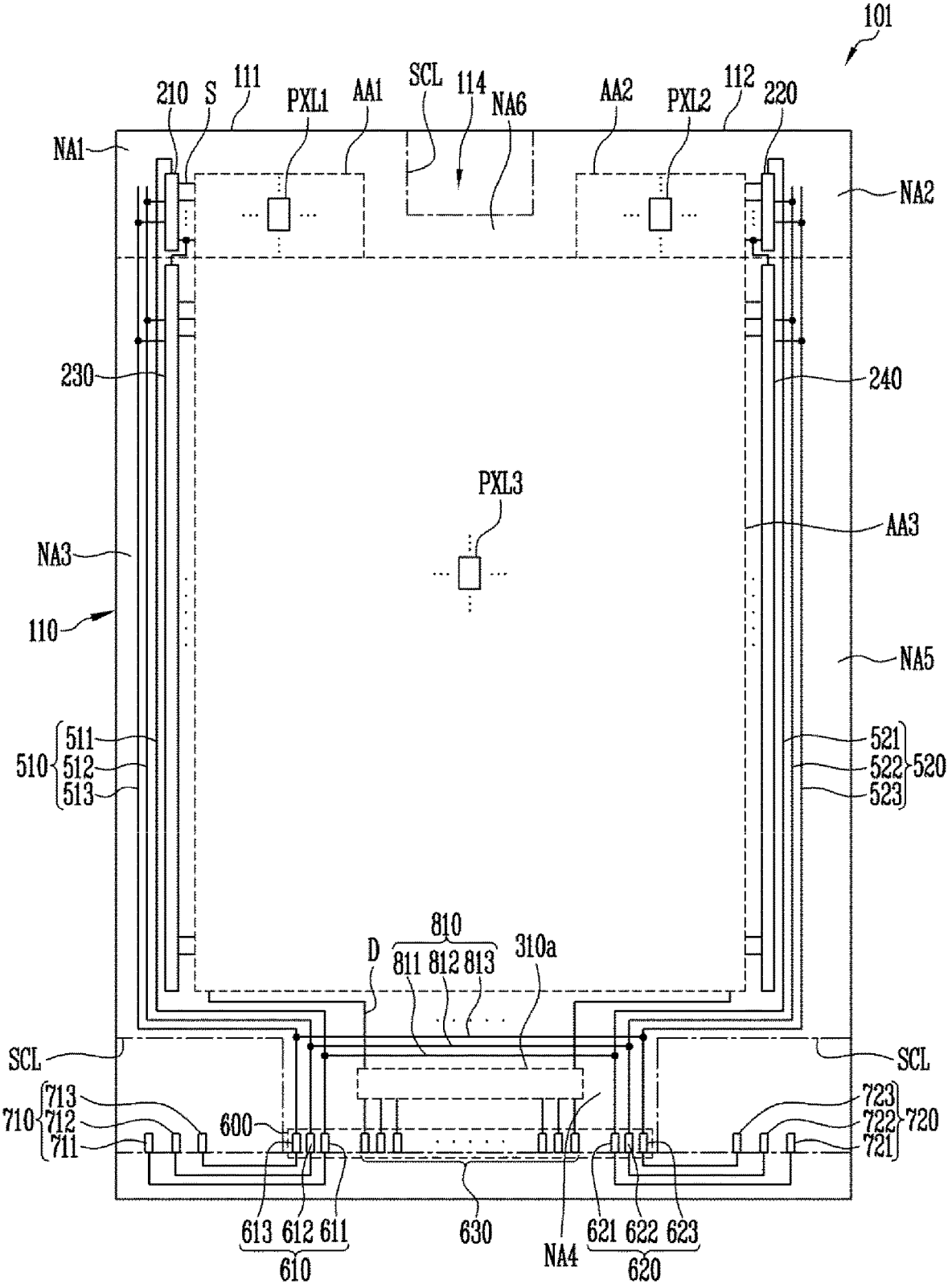
FIG. 15A illustrates an individual panel area according to another embodiment of the present disclosure.
Figure 15B:
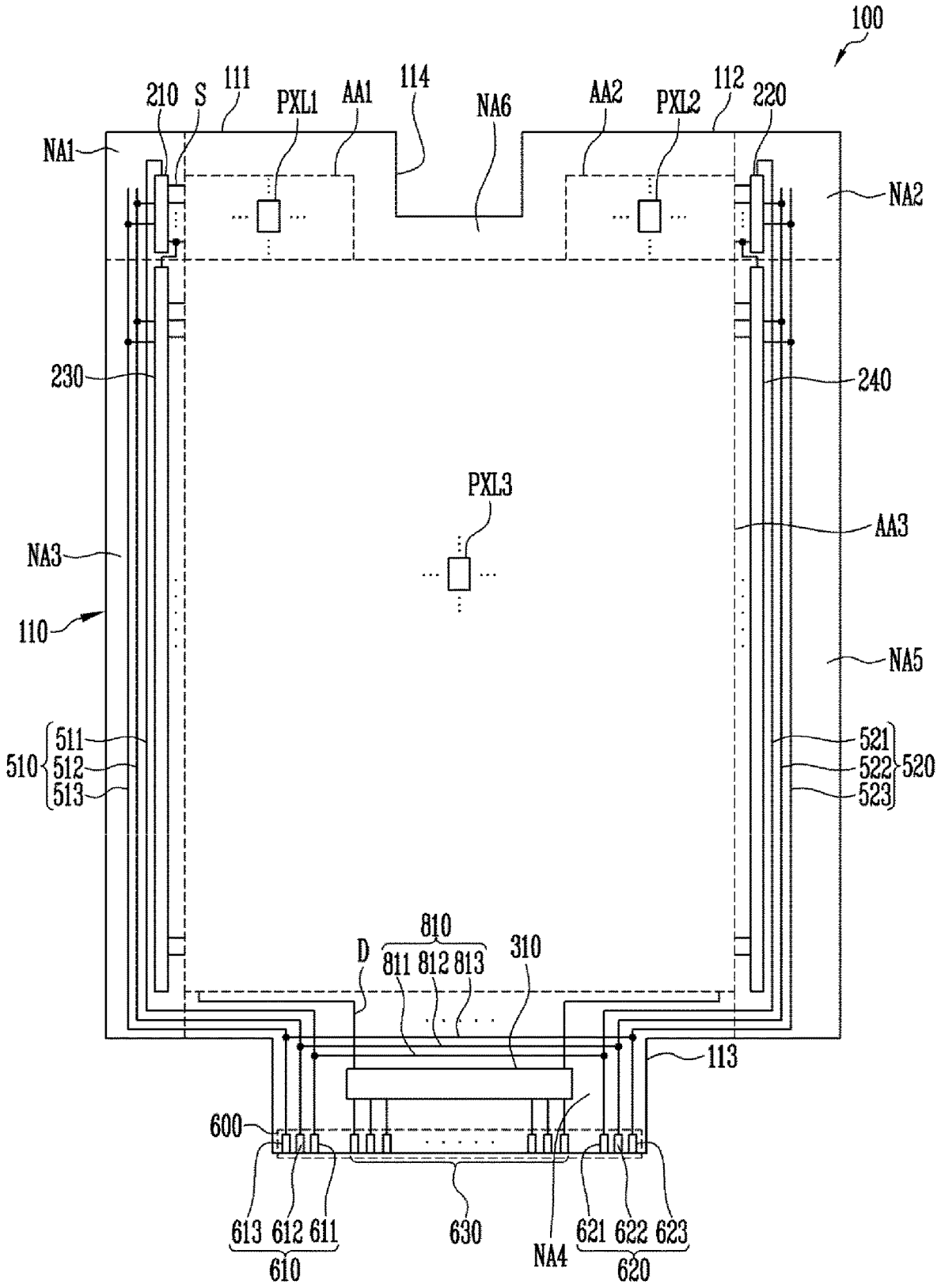
FIG. 15B illustrates a display device according to another embodiment of the present disclosure, for example, a display device fabricated by performing a scribing process on the individual panel shown in FIG. 15A.

FIG. 15A illustrates an individual panel area according to another embodiment of the present disclosure. FIG. 15B illustrates a display device according to another embodiment of the present disclosure, for example, a display device fabricated by performing a scribing process on the individual panel shown in FIG. 15A. In FIGS. 15A and 15B, the same constituent elements as those of the above-described embodiments are designated by the same reference numerals, and a detailed description thereof will be omitted.

Referring to FIGS. 15A and 15B, the connecting wires 810 may be disposed in the fourth non-pixel area NA4 in which the pad portion 600 is located. For example, the connecting wires 810 may be disposed between the third pixel area AA3 and the data driver mounting area 310*a*. In this case, the connecting wires 810 may be disposed in a different layer from the data lines D to be insulated from the data lines D. That is, according to an embodiment, the interconnecting wires 810 may be disposed at various locations inside the scribing line SCL.

Figure 16A:
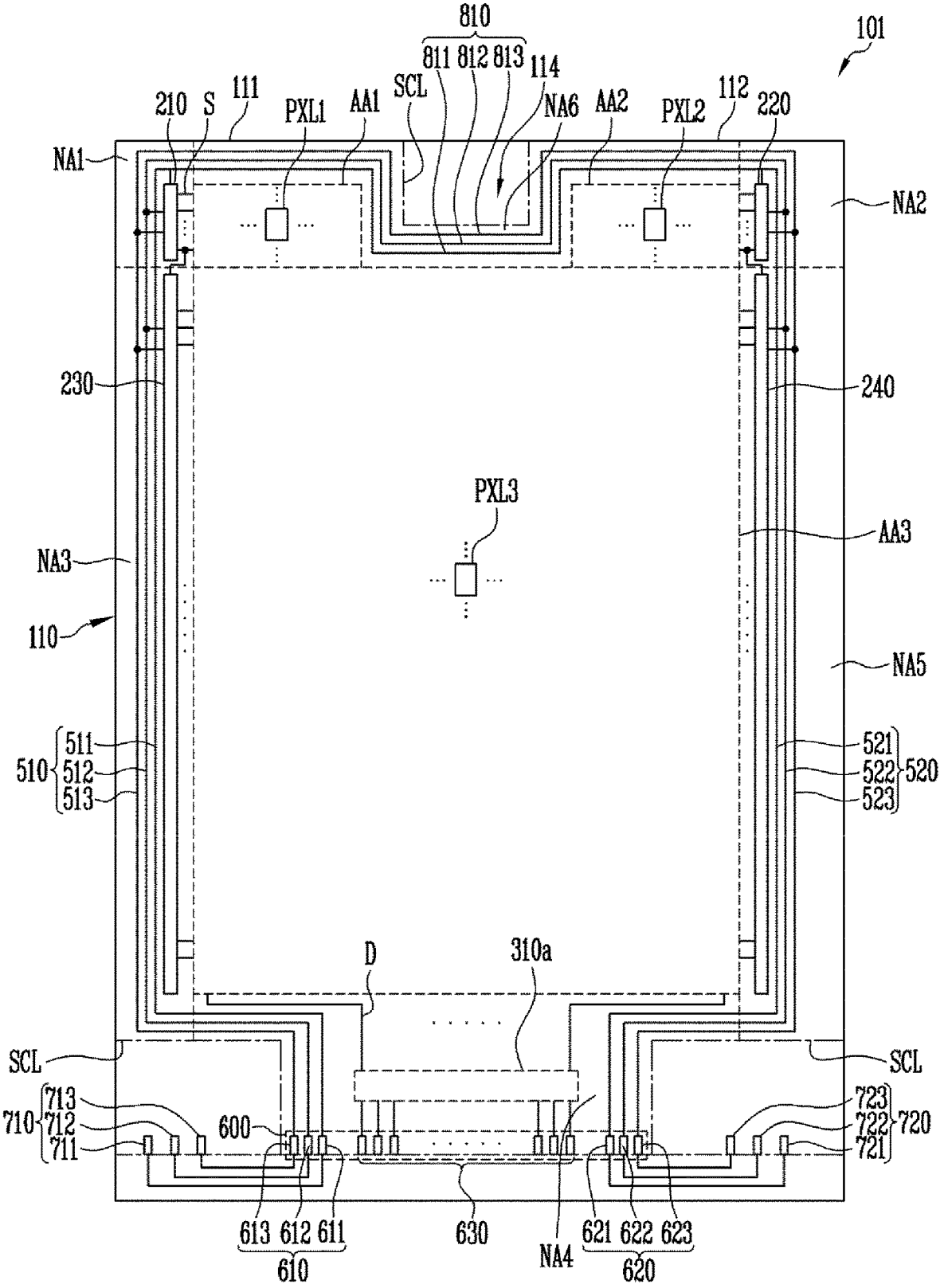
FIG. 16A illustrates an individual panel area according to another embodiment of the present disclosure.
Figure 16B:
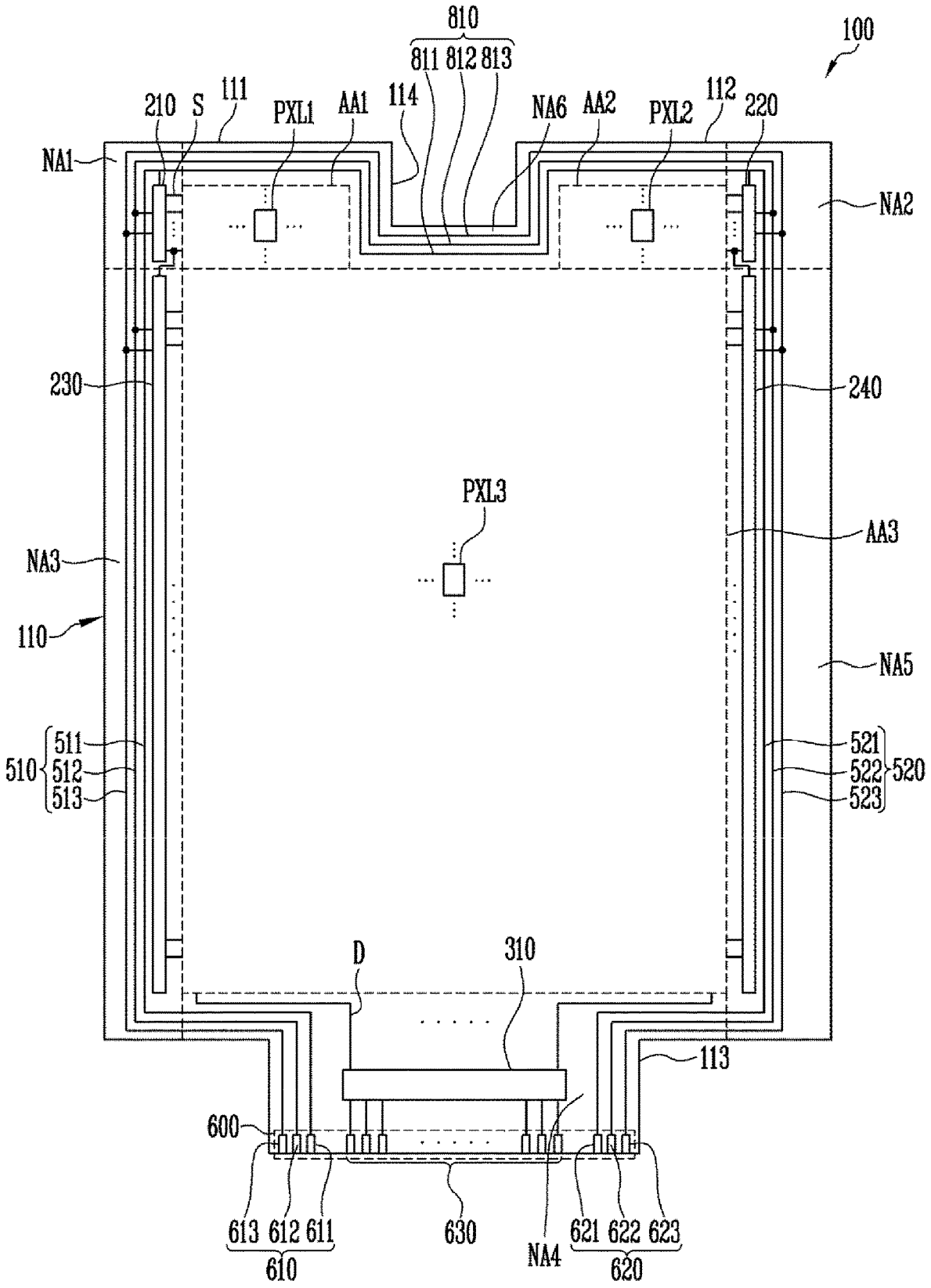
FIG. 16B illustrates a display device according to another embodiment of the present disclosure, for example, a display device fabricated by performing a scribing process on the individual panel shown in FIG. 16A.

FIG. 16A illustrates an individual panel area according to another embodiment of the present disclosure. FIG. 16B illustrates a display device according to another embodiment of the present disclosure, for example, a display device fabricated by performing a scribing process on the individual panel shown in FIG. 16A. In FIGS. 16A and 16B, the same constituent elements as those of the above-described embodiments are designated by the same reference numerals, and a detailed description thereof will be omitted.

Referring to FIGS. 16A and 16B, the connecting wires 810 may be disposed in the sixth non-pixel area NA6 connecting the first and second non-pixel areas NA1 and NA2. That is, the connecting wires 810 may electrically connect the first and second wires 510 and 520 to each other on an upper end of the display device 100. In addition, the positions of the connecting wires 810 may be variously changed.

According to the display device and the method of fabricating the same according to the embodiment of the present disclosure, each pixel area of the display device includes first and second pixel areas spaced apart from each other so that at least the scan lines are separated from each other. Embodiments allow for this configuration to be effectively driven, and also allow for a defect rate to be reduced.

While the present disclosure has been particularly shown and described with reference to exemplary embodiments thereof, but it is to be understood that the embodiments are for the purpose of illustration only and are not to be construed as limitation. It will be apparent to those skilled in the art that various modifications may be made without departing from the scope of the present disclosure.

The scope of the present disclosure is not limited to the details described in the detailed description of the specification, but should be defined by the claims. In addition, all changes or modifications derived from the meaning and scope of the claims and equivalents thereof should be construed as being included within the scope of the present disclosure. Various features of the above described and other embodiments can be mixed and matched in any manner, to produce further embodiments consistent with the invention.

What is claimed is:

1. A display device, comprising:

a substrate including a display area, a first non-pixel area disposed on one side of the display area, a second non-pixel area disposed on another side of the display area, and a third non-pixel area between the first non-pixel area and the second non-pixel area;

first scan lines and first pixels connected to the first scan lines and disposed in the display area;

second scan lines and second pixels connected to the second scan lines and disposed in the display area;

a first scan driver disposed in the first non-pixel area and connected to the first scan lines;

a second scan driver disposed in the second non-pixel area and connected to the second scan lines;

a plurality of first wires disposed in the first non-pixel area and connected to the first scan driver;

a plurality of second wires disposed in the second non-pixel area and connected to the second scan driver;

first scan pads in the third non-pixel area connected to the plurality of first wires and second scan pads in the third non-pixel area connected to the plurality of second wires; and a plurality of connecting wires in the third non-pixel area connecting the first wires and the second wires.

2. The display device of claim 1, wherein the display area includes a first pixel area and a second pixel area apart from each other, wherein the first pixels are disposed in the first pixel area and the second pixels are disposed in the second pixel area, wherein the first non-pixel area is disposed outside the first pixel area with respect to an area center of the first and second pixel areas, and wherein the second non-pixel area is disposed outside the second pixel area with respect to the area center.

3. The display device of claim 2, wherein the first pixel area and the second pixel area are arranged proximate to each other to be spaced apart from each other along an extension line extending in a longitudinal direction of the first scan lines and the second scan lines.

4. The display device of claim 2, wherein the first pixel area and the second pixel area are arranged to be opposite to each other with at least one non-pixel area interposed therebetween.

5. The display device of claim 1, wherein the first and second wires are arranged to supply at least one of a start pulse and a clock signal to the first and second scan drivers, respectively.

6. The display device of claim 2, further comprising:

a third pixel area on one side of the first and second pixel areas;

third scan lines and third pixels in the third pixel area; and a third scan driver in a fourth non-pixel area at a periphery of the third pixel area and connected to the third scan lines.

7. The display device of claim 6, wherein the first wires extend to the first non-pixel area via the fourth non-pixel area, from the third non-pixel area in which the first scan pads are arranged.

8. The display device of claim 7, wherein at least one of the first wires is connected to the first scan driver and the third scan driver.

9. The display device of claim 6, further comprising a fourth scan driver in a fifth non-pixel area at the periphery of the third pixel area and connected to the third scan lines.

10. The display device of claim 9, wherein at least one of the second wires is connected to the second scan driver and the fourth scan driver.

11. The display device of claim 6, wherein the second wires extend to the second non-pixel area via a fifth non-pixel area opposite to the fourth non-pixel area, from the third non-pixel area in which the second scan pads are arranged.

12. The display device of claim 1, wherein the first wires include a first signal line configured to receive a first control signal, and a second signal line configured to receive a second control signal, the second wires include a third signal line configured to receive the first control signal and a fourth signal line configured to receive the second control signal, and the connecting wires include a first connecting wire connecting the first signal line and the third signal line, and a second connecting wire connecting the second signal line and the fourth signal line.

13. The display device of claim 12, wherein the first connecting wire and the second connecting wire have a same structure.

14. The display device of claim 13, wherein each of the first and second connecting wires includes:

a first sub wire disposed between the plurality of first wires and the plurality of second wires and formed of a same material and on a same layer as the second and fourth signal lines, a second sub wire connected between the first sub wire and the second signal line and arranged on a different layer from the first sub wire, and a third sub wire connected between the first sub wire and the fourth signal line and arranged on a different layer from the first sub wire.

15. The display device of claim 12, wherein the first connecting wire and the second connecting wire have different structures.

16. The display device of claim 15, wherein the second connecting wire includes a first sub wire disposed between the plurality of first wires and the plurality of second wires and formed of a same material and on a same layer as the second and fourth signal lines, a second sub wire connected between the first sub wire and the second signal line and arranged on a different layer from the first sub wire, and a third sub wire connected between the first sub wire and the fourth signal line and arranged on a different layer from the first sub wire, and wherein the first connecting wire is formed of a single wire arranged to be spaced apart from the first sub wire and on a same layer as the first sub wire, or a single wire arranged to be spaced apart from the second and third sub wires and on a same layer as the second and third sub wires.

17. The display device of claim 1, wherein the display area includes a first pixel area and a second pixel area apart from each other with a concave portion therebetween, and wherein the first pixels are disposed in the first pixel area and the second pixels are disposed in the second pixel area.

18. The display device of claim 1, wherein the display area includes:

a first pixel area in which the first pixels are disposed;

a second pixel area in which the second pixels are disposed, the second pixels being apart from the first pixels;

a third pixel area on one side of the first and second pixel areas in which third scan lines and third pixels are disposed;

a fourth pixel area on another side of the first and second pixel areas in which fourth scan lines and fourth pixels are disposed, and wherein each of the first scan driver and the second scan driver is connected to the third scan lines and the fourth scan lines.

19. The display device of claim 1, further comprising:

a data driver in the third non-pixel area connected to the first pixels and the second pixels, wherein the plurality of connecting wire are between the data driver and the first and second pads.

20. The display device of claim 1, further comprising:

a data driver in the third non-pixel area connected to the first pixels and the second pixels, wherein the plurality of connecting wire are between the data driver and the first and second pixel areas.

* * * * *